US006561262B1

(12) United States Patent
Osakabe et al.

(10) Patent No.: US 6,561,262 B1
(45) Date of Patent: May 13, 2003

(54) BOILING AND COOLING APPARATUS

(75) Inventors: Hiroyuki Osakabe, Chita-gun (JP); Hajime Sugito, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/518,451

(22) Filed: Mar. 3, 2000

(30) Foreign Application Priority Data

| | | |
|---|---|---|
| Mar. 5, 1999 | (JP) | 11-057896 |
| Jul. 14, 1999 | (JP) | 11-200906 |
| Jul. 14, 1999 | (JP) | 11-200966 |
| Oct. 20, 1999 | (JP) | 11-298636 |
| Oct. 22, 1999 | (JP) | 11-301608 |
| Nov. 19, 1999 | (JP) | 11-330489 |
| Nov. 19, 1999 | (JP) | 11-330583 |

(51) Int. Cl.[7] ..... F28D 15/00

(52) U.S. Cl. ..... 165/104.21; 165/104.33; 361/700; 257/715

(58) Field of Search ..... 165/80.4, 104.33, 165/104.21; 361/699, 700; 257/715

(56) References Cited

U.S. PATENT DOCUMENTS

| | | | | |
|---|---|---|---|---|
| 3,486,489 A | * | 12/1969 | Huggins | 165/183 |
| 5,036,909 A | * | 8/1991 | Whitehead et al. | 165/133 |
| 5,713,413 A | * | 2/1998 | Osakabe et al. | 165/104.33 |
| 5,823,248 A | | 10/1998 | Kadota et al. | |
| 5,871,043 A | | 2/1999 | Osakabe et al. | |
| 5,931,226 A | * | 8/1999 | Hirano et al. | 165/183 |
| 6,005,772 A | * | 12/1999 | Terao et al. | 361/699 |
| 6,073,683 A | * | 6/2000 | Osakabe et al. | 165/104.33 |
| 6,076,596 A | * | 6/2000 | Osakabe et al. | 165/104.33 |
| 6,247,529 B1 | * | 6/2001 | Shimizu et al. | 165/183 |
| 6,257,324 B1 | * | 7/2001 | Osakabe et al. | 165/104.33 |
| 6,279,649 B1 | * | 8/2001 | Osakabe | 165/104.33 |

FOREIGN PATENT DOCUMENTS

| | | |
|---|---|---|
| EP | 0 409 179 A1 | 1/1991 |
| JP | A-57-204156 | 12/1982 |
| JP | A-8-204075 | 8/1996 |
| JP | A-8-236669 | 9/1996 |
| JP | A-9-167818 | 6/1997 |
| JP | A-11-200966 | 7/1999 |

* cited by examiner

*Primary Examiner*—Henry Bennett
*Assistant Examiner*—Temell McKinnon
(74) *Attorney, Agent, or Firm*—Harness, Dickey & Pierce, P.L.C.

(57) ABSTRACT

A boiling and cooling apparatus is provided which has a refrigerant tank for maintaining a liquid refrigerant for boiling when it receives heat from a heating body, a radiator which receives refrigerant vapor boiled in the refrigerant tank. The radiator cools refrigerant vapor to form the liquid refrigerant by exchanging heat with an external fluid. The radiator includes a first passage for receiving the refrigerant vapor and a second passage for returning condensed liquid to the refrigerant tank. The radiator has an upper space which provides communication between the first passage and the second passage, whereby the refrigerant vapor is guided to flow preferentially into the first passage.

27 Claims, 34 Drawing Sheets

FIG. 7A
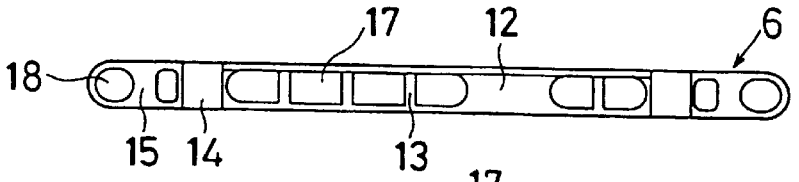
FIG. 7C
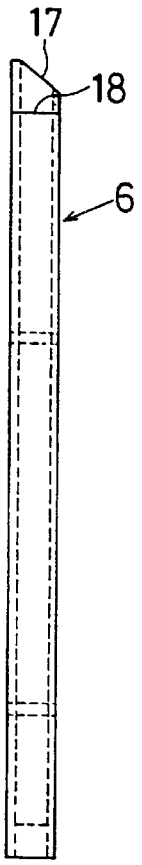
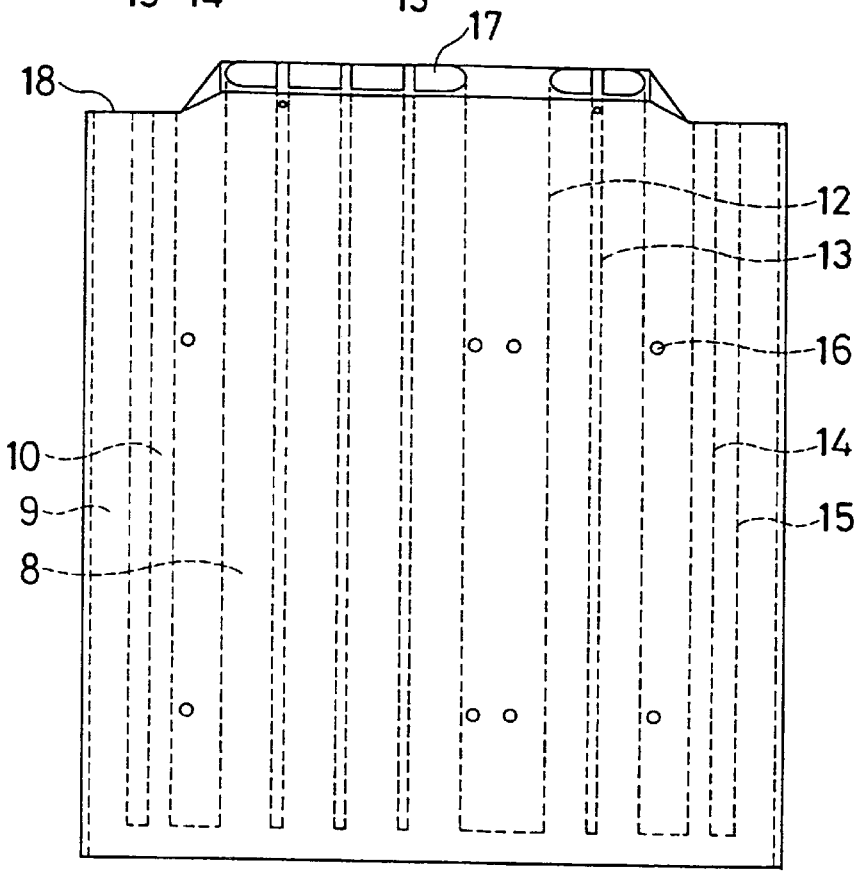
FIG. 7B
FIG. 8
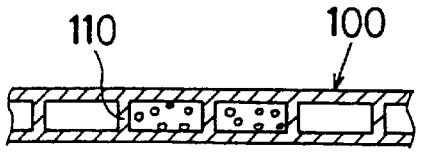

FIG. 18A
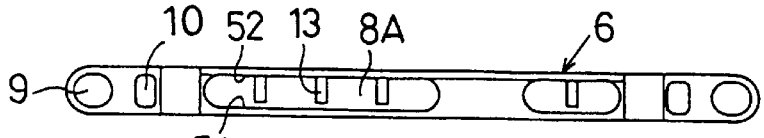
FIG. 18C
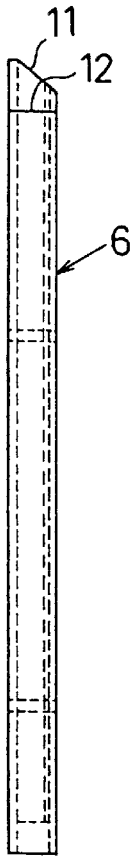
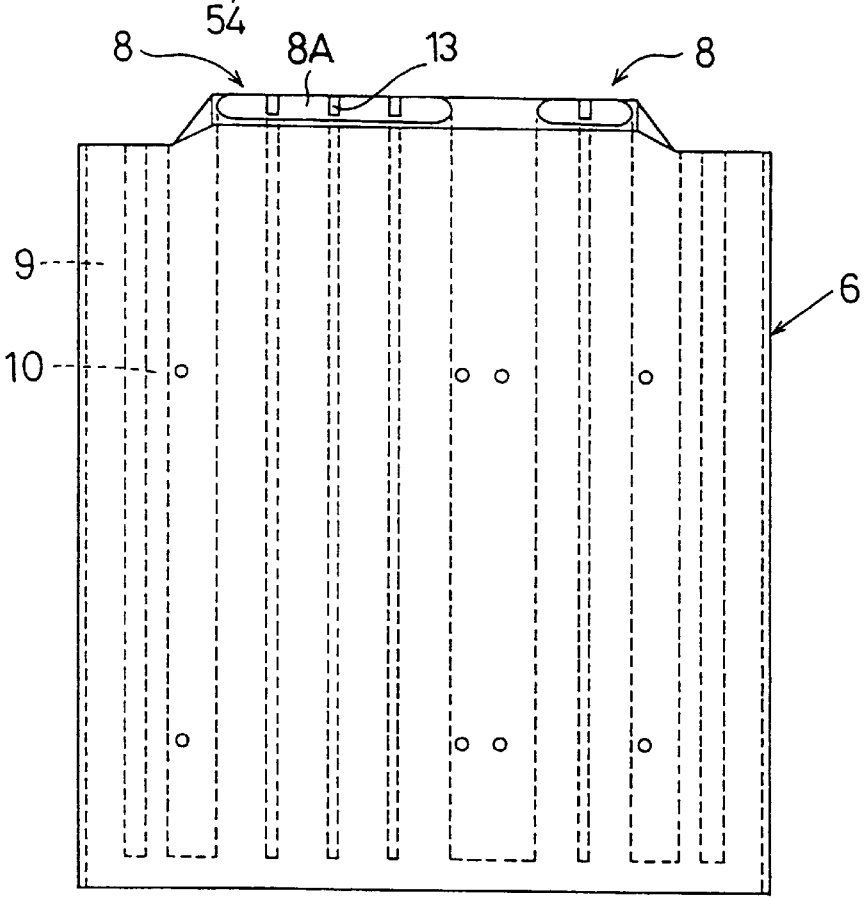
FIG. 18B

FIG. 29B
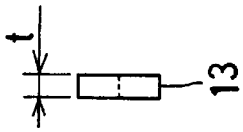
FIG. 29A
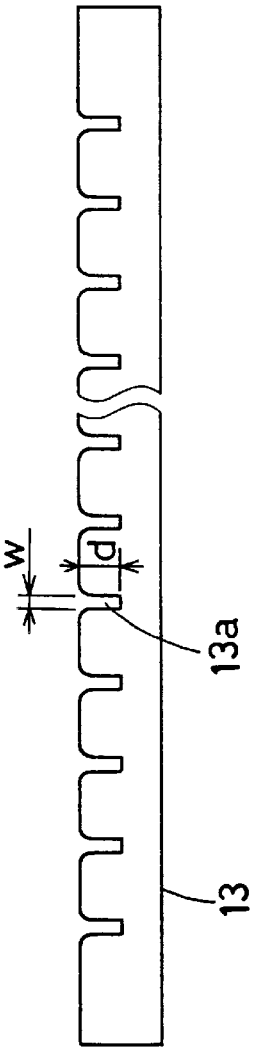
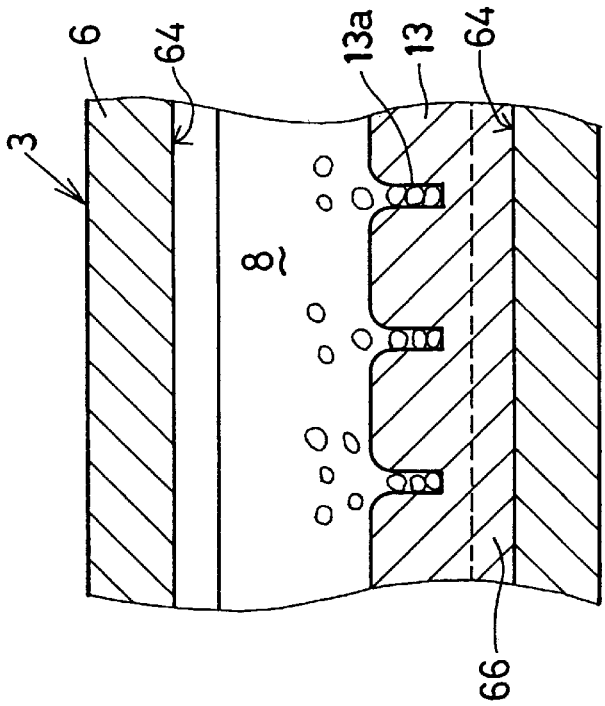
FIG. 30

BOILING AND COOLING APPARATUS

CROSS-REFERENCE TO RELATED APPLICATION

The present invention is related to Japanese patent application No. Hei. 11-57896, filed Mar. 5, 1999; No. Hei. 11-298636, filed Oct. 20, 1999; No. Hei. 11-301608, filed Oct. 22, 1999; No. Hei. 11-330583, filed Nov. 19, 1999; No. Hei. 11-330489, filed Nov. 19, 1999; No. Hei. 11-200906, filed Jul. 14, 1999; and No. Hei. 11-200966, filed Jul. 14, 1999; the contents of which are incorporated herein by reference.

FIELD OF THE INVENTION

The present invention relates to a boiling and cooling apparatus for transferring heat from a heating body, and more particularly, to a boiling and cooling apparatus for transferring heat which reduces burnout, increases cooling tank rigidity and increases heat transfer performance.

BACKGROUND OF THE INVENTION

Presently, boiling and cooling systems have been constructed to cool components, such as IGBT modules. One such system is disclosed in Japanese Patent Application Laid Open No. 8-78588. As shown in FIG. 5, this boiling and cooling apparatus includes a refrigerant tank 100 for reserving a liquid refrigerant and a radiator 110 disposed over the refrigerant tank 100. In the radiator 110, corrugated inner fins 120 are provided which are offset to the left side, as shown. As a result of this construction, refrigerant vapor is first boiled by heat from heating body 130. The boiled refrigerant rises in passage 140, after formation on the right side of inner fins 120 in radiator 110. The vapor flows into upper space 150 in radiator 110, where it is cooled into a condensed liquid by an external fluid, until it can be recirculated into the refrigerant tank 100 via the internal passages of the inner fins 120.

While this device provides cooling to a selected component, there exist some drawbacks with respect to its operation. Specifically, in the aforementioned boiling and cooling apparatus, the lower end opening of the radiator 110 and the upper end opening of the refrigerant tank 100 communicate with each other over their entire faces. As a result, refrigerant vapor, boiled in refrigerant tank 100, is blown up to the lower end face of inner fins 120 and interferes with the condensed liquid flowing down in the internal passages of the inner fins 120. This impedes refrigerant circulation.

Another such invention is disclosed in Japanese Patent Application Laid-Open No. 8-236669. In this cooling apparatus, as shown in FIG. 3, the boiling area in a refrigerant tank 100 is increased to improve radiation performance. This increase in boiling area is accomplished by arranging fins 120 proximate the boiling face in the refrigerant tank 100, thereby receiving the heat of the heating body 110 mounted to the surface of the refrigerant tank 100.

To accomplish this task, fins 120 are arranged in the refrigerant tank 100 to form a plurality of passage portions 130, in which the vaporized refrigerant (or bubbles) rise. Some of the individual passage portions 130 have more or less bubbles than the remainder. The number of bubbles in each passage is dependant upon the position of the heating portion of heating body 110 with respect to the passage. The higher the position of passage portions 130 toward the radiator, the more the number of bubbles increases. As such, the small bubbles join together to form larger bubbles. In the passages containing a large number of bubbles, the boiling faces are typically covered with bubbles, thereby lowering the boiling heat transfer coefficient. As a result, it is possible that the boiling face may undergo an abrupt temperature rise (or burnout).

This problem is excentuated even more when the fin pitch is reduced to retain a larger boiling area. In such an instance, the passage portions 130 have reduced open areas and are almost filled with the bubbles. This seriously reduces the quantity of refrigerant flowing through the system, making burnout on the boiling faces highly probable.

Another boiling and cooling device is disclosed in Japanese Patent Application No. 11-200966 (assigned to the assignee of the present invention). Here, a boiling and cooling apparatus is proposed, in which the ribs are provided on only the side of the inner wall, proximate to the heating body, and clearances are provided at their leading ends.

While this device does provide an increased radiation area, it is still desirable to obtain a larger radiation area, especially for increased heat load due to increased heat flux. Moreover, if the ribs are made of an extrusion molding to reduce cost, it is difficult to make a finer rib structure to increase the radiation area, resulting in an inability to cope with a higher heat flux.

Likewise, another, such boiling and cooling apparatus is disclosed in Japanese Patent Application Laid-Open No. 9-167818. This boiling and cooling apparatus includes a refrigerant tank made of an extruded member. An IGBT module acts as the heating body, and is mounted on the surface of the refrigerant tank. On its inside, the refrigerant tank is divided into a plurality of passage-shaped spaces 130, as shown in FIGS. 4 and 8, by ribs 110. As shown, ribs 110 are formed on extruded member 100.

While this device does provide boiling and cooling functions, it has several drawbacks. Here, the IGBT module does not have a uniform radiation temperature all over its radiation area to contact with the surface of the refrigerant tank. Instead, this device provides a temperature distribution transversely (or in the horizontal direction of FIG. 4) in the refrigerant tank. With the inside of the refrigerant tank being divided into the plurality of passages by the ribs 110, the bubbling rates are different among the individual passages, thereby providing a higher number of bubbles in passages 120 and a lower number of bubbles in passages 130, as shown in FIG. 4. As a result, burnout occurs in the more bubbled passages 120, thereby reducing radiation performance. This problem arises most often when the radiation of the heating body increases, especially when the amount of refrigerant in the refrigerant tank is lowered, or thinned to reduce cost.

Moreover, another problem arising with respect to Japanese Patent Application Laid-Open No. 9-167818 involves the mounting of the refrigerant tank 100. When the heating body 110 is mounted on only one side (or one surface) of the refrigerant tank 100, the ribs 120 become lower in temperature as they get further away from the heating body mounting side. This is graphically illustrated in FIG. 2. In the non-boiling region, the boiling overheat drops to provide no effective boiling region. As a result, in the non-boiling region of the ribs 120, ribs 120 do not increase the radiation area. However, the presence of the ribs 120 obstructs the boiling flow (or the flow of bubbles) rising in the refrigerant tank 100 and may cause the burnout.

Also, as illustrated in FIG. 1, the sectional area of each hollow portion is reduced because the vigorous boiling region 210 is defined into the plurality of hollow portions 160. As radiation increases the amount of bubbling, the boiling faces forming hollow portions 160 are covered with bubbles. As a result, the temperature of the boiling faces may abruptly rise to cause burnout.

Systems have been devised to overcome the above-discussed as well as other overheating problems. Such systems include providing a boiling and cooling device which increases its boiling area by forming a porous layer in the boiling portion. Refrigerants can be used, such as freon or the like, which have a low surface tension and therefore easily wet a surface. In this instance, a bubbling point structure as small as about several microns is required for stabally producing bubble nuclei necessary to boil the refrigerant. However, the machining required to produce such a small bubbling point structure is seriously difficult to manufacture. Moreover, the cost of such an endeavor is extremely high, thereby reducing its practicality. The present invention was developed in light of these drawbacks.

SUMMARY OF THE INVENTION

It is therefore an object of the present invention to provide a boiling and cooling apparatus, which improves radiation performance by promoting the refrigerant circulation in the radiator by providing an entrance and exit flow path for the refrigerant.

It is yet another object of the present invention to provide a boiling and cooling apparatus, which improves the burnout resistance by providing ribs for increasing the radiation area of the refrigerant tank.

It is another object of the present invention to provide a boiling and cooling device having an intermediate wall portion to divide the refrigerant tank into a region which has a higher temperature and a region which has a lower temperature to isolate the differing boiling regions.

A boiling and cooling apparatus is provided which has a refrigerant tank for maintaining a liquid refrigerant for boiling when it receives heat from a heating body, a radiator which receives refrigerant vapor boiled in the refrigerant tank. The radiator cools refrigerant vapor to form the liquid refrigerant by exchanging heat with an external fluid. The radiator includes a first passage for receiving the refrigerant vapor and a second passage for returning condensed liquid to the refrigerant tank. The radiator has an upper space which provides communication between the first passage and the second passage, whereby the refrigerant vapor is guided to flow preferentially into the first passage.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 7*a* is a front elevation view of the boiling and cooling apparatus according to the present invention;

FIG. 7*b* is a top elevation view of the boiling and cooling apparatus according to the present invention;

FIG. 7*c* is a side elevation view of the boiling and cooling apparatus according to the present invention;

FIG. 8 is a cross-sectional view of the boiling and cooling apparatus according to the prior art;

FIG. 18*a* is a front elevation view of a refrigerant tank for a boiling and cooling device according to the present invention;

FIG. 18*b* is a top elevation view of a refrigerant tank for a boiling and cooling device according to the present invention;

FIG. 18*c* is a side elevation view of a refrigerant tank for a boiling and cooling device according to the present invention;

FIG. 29*a* is a side view of a rib for a boiling and cooling device according to the present invention;

FIG. 29*b* is a front view of a rib for a boiling and cooling device according to the present invention;

FIG. 30 is a partial front cross-sectional view along plane IV—IV of the refrigerant tank of FIG. 31*a* for a boiling and cooling device according to the present inventions;

DETAILED DESCRIPTION OF THE PREFERRED EMBODIMENTS

Figure 6:
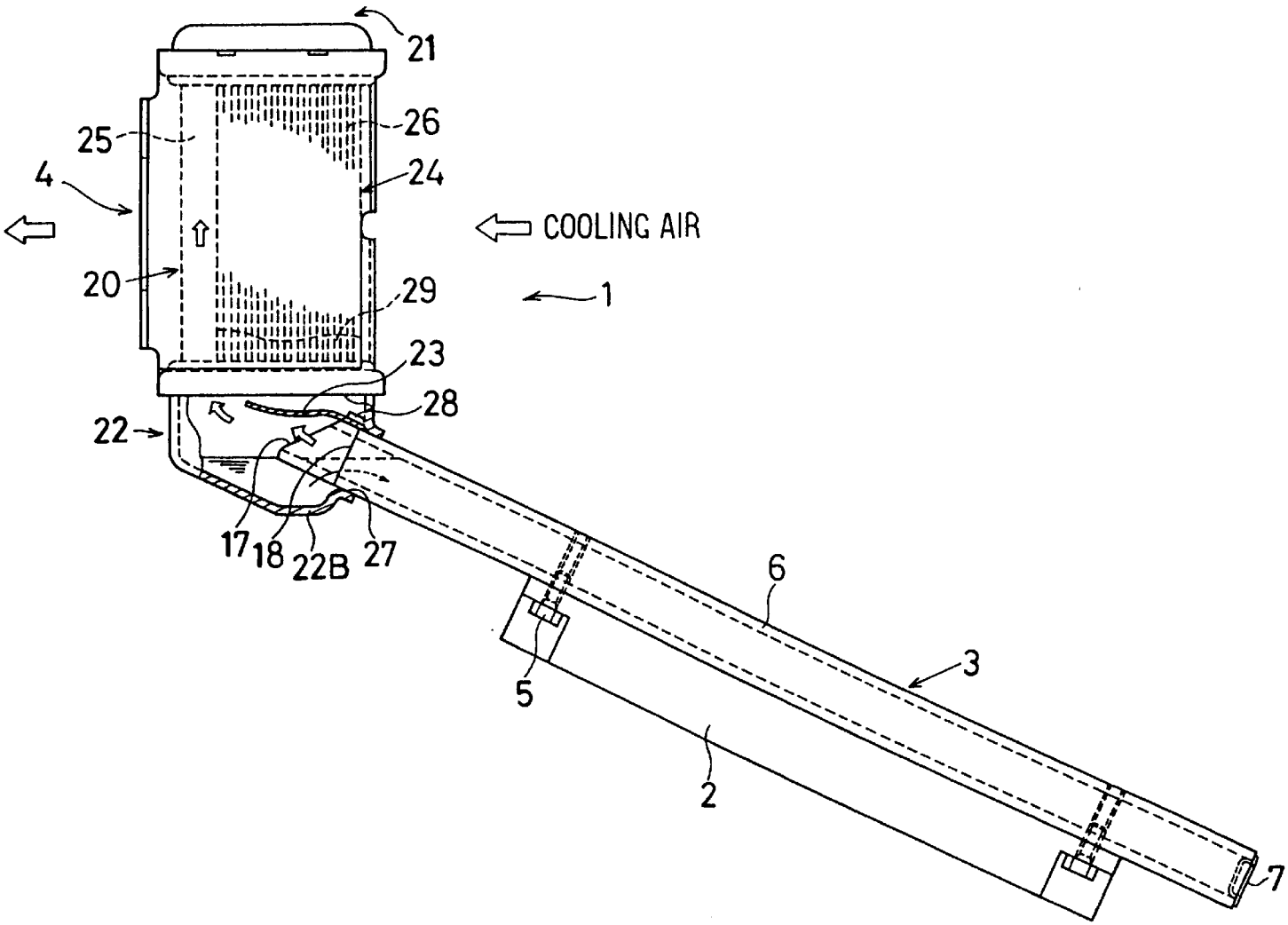
FIG. 6 is a side elevation view of a boiling and cooling apparatus according to the present invention.

Referring now to FIG. 6, a side elevation of a boiling and cooling apparatus 1 is shown. Here, a boiling and cooling apparatus cools a heating body 2 by repeatedly boiling and condensing a refrigerant. To accomplish this function, the boiling and cooling apparatus is provided with a refrigerant tank 3, containing a liquid refrigerant, and a radiator 4 assembled above the refrigerant tank 3. The refrigerant tank 3 and radiator 4 are integrally manufactured by soldering these items together. The portion of the refrigerant tank which dissipates heat to the coolant is the boiling face. Likewise, the portion of heating body 2 dissipating heat to the refrigerant tank is the radiation face.

In FIG. 6, heating body 2 is illustrated as an IGBT module for an inverter circuit of an electric car. Moreover, heating body 2 is fixed in close contact to the surface of the refrigerant tank 3 by means of bolts 5, as shown in FIG. 6.

Figure 10:
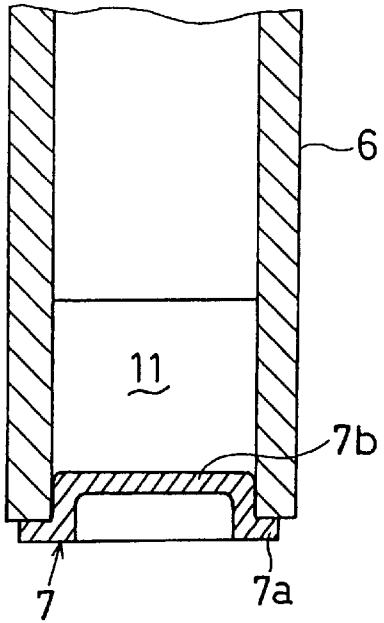
FIG. 10 is a sectional view of a mounted end plate in a boiling and cooling apparatus according to the present invention.

Refrigerant tank 3 is constructed of a hollow member 6 mated with an end plate (see FIG. 10). Hollow member 6 is preferably an extrusion molding of a metallic material having an excellent thermal conductivity, such as aluminum. As shown in FIG. 7*a*, hollow member 6 is preferably a flat shape which has a smaller thickness than width. Hollow member 6 contains refrigerant chambers 8, liquid returning passages 9 and thermal insulation passages 10 therein (which will be described in greater detail hereinafter).

As shown in FIG. 7*b*, the upper end of hollow member 6 extends upward to different levels from its left to right ends, thereby causing the central portion of hollow member 6 to extend upward higher than its left and right ends. As such, liquid returning passages 9, thermal insulation passages 10, and refrigerant chambers 8 extend upward to different elevations.

As shown in FIG. 7*c*, hollow member 6 is sloped at an upper end face as shown. The upper end face of the hollow member 6 contains upper end openings, hereinafter referred to as vapor outlets 17. Likewise, liquid returning passages 9 also contain upper end openings. These upper end openings of liquid returning passages 9 are hereinafter referred to as liquid inlets 18. As can be seen, vapor outlets have a slight inclination with respect to liquid inlets 18.

In a first embodiment of the present invention, the refrigerant chambers 8 are formed (See FIG. 7*a*) on opposite sides of first passage wall 12, between third passage walls 14. Each refrigerant chamber 8 comprises a plurality of passages, defined by ribs 13. Refrigerant chambers 8 form spaces, allowing liquid refrigerant to be contained therein and boiled by heat from heating body 2.

Figure 9A:
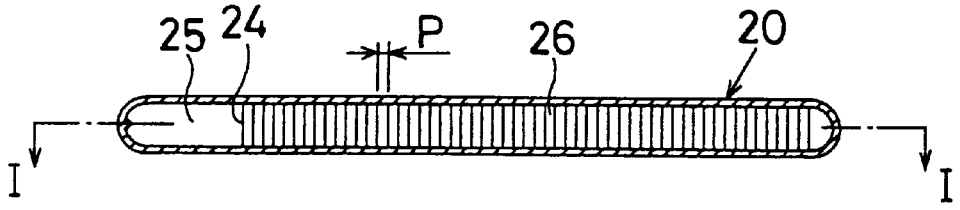
FIG. 9*a* is a front cross-sectional view of an upper tube of a boiling and cooling apparatus according to the present invention.

The radiator 4 contains a number of elements, which are assembled to form a refrigerant circulating passage. Referring to FIG. 9*a*, the refrigerant circulating passage is formed by inserting inner fins 24 into tubes 20 to form vapor passages 25 and condensed liquid passages 26. Inner fins 24 act to increase the condensation area for condensing refrigerant vapor. In addition, a refrigerant flow control plate 23 (see FIG. 6) is disposed in lower, tank 22 to introduce refrigerant vapor, which exits vapor outlets 17, into vapor passages 25 of tubes 20. As a result of control plate 23, vapor is more effectively directed to tubes 20, thereby promoting refrigerant circulation in radiator 4 and improving radiator performance.

In lower tank 22, liquid inlets 18 are opened at a lower level than vapor outlets 17. As such, condensed liquid, which has dripped from tubes 20 into lower tank 22, flows into liquid inlets 18. As a result, condensed liquid returns to refrigerant chambers 8 at a highly efficient rate. This promotes refrigerant circulation in the refrigerant tank 3, thereby suppressing burnout of the boiling face.

Figure 38:
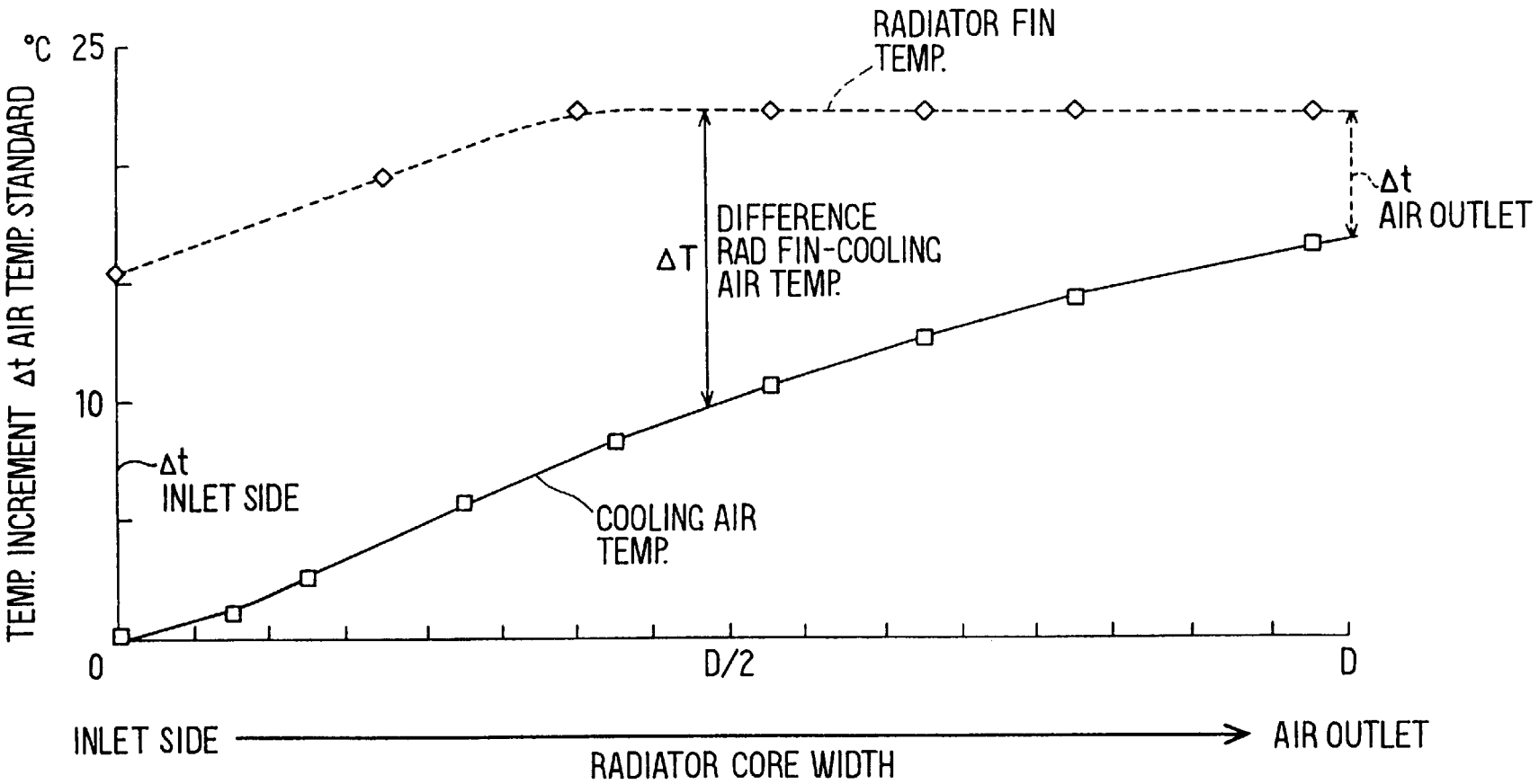
FIG. 38 is a graphical representation of a boiling and cooling apparatus according to the present invention.

Cooling wind is channeled through radiator 4 to absorb latent heat of refrigerant vapor when it passes through radiator 4. This absorption causes the temperature of the cooling wind, to rise. Radiation from radiator 4 is substantially proportional to the temperature difference between the radiation fin temperature and the cooling wind temperature. As shown in FIG. 38, it is observed that radiation is higher at the entrance side than at the exit side of the cooling wind, with respect to the longitudinal direction of the tubes. As such, when inner fins 24 are inserted into tubes 20, it is advisable to arrange the inner fins 24 so that the condensation area is larger on the cooling wind entrance side. In other words, forming the condensed liquid passages 26 on the cooling wind entrance side in the tubes 20 and the vapor passages 25 on the cooling wind exit side will result in a more effective system.

Liquid returning passages 9 are provided on both sides of the hollow member 6. These passages allow the condensed liquid, cooled and liquefied by the radiator 4, to flow back to the refrigerant tank 3. Also, thermal insulation passages 10 are provided in refrigerant tank 3 which thermally insulate the refrigerant chambers 8 from the liquid returning passages 9, and are disposed adjacent to the inner sides (or to the sides of the central portion) of the liquid returning passages 9.

Figure 11A:
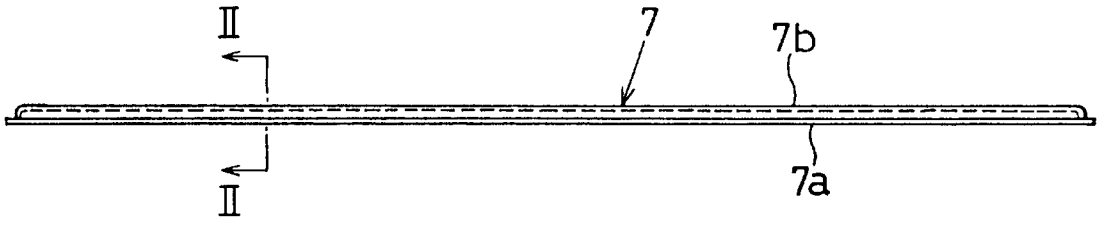
FIG. 11*a* is a side elevation view of an end plate for a boiling and cooling apparatus according to the present invention.
Figure 11B:
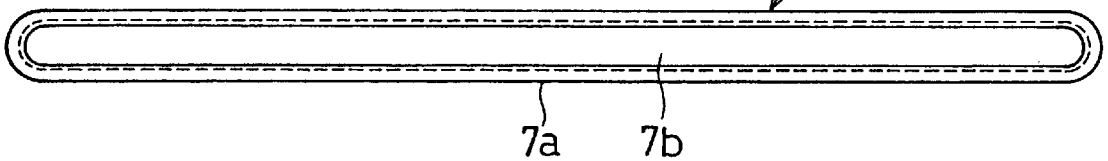
FIG. 11*b* is a top plan view of an end plate for a boiling and cooling apparatus according to the present invention.
Figure 11C:
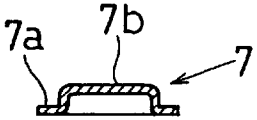
FIG. 11*c* is a cross-sectional view along plane 11—11 of the end plate of FIG. 11*a* for a boiling and cooling apparatus according to the present invention.

Like hollow member 6, end plate 7 is made of aluminum. As shown in FIGS. 10 and 11, end plate 7 is transversely elongated to have an outer peripheral edge portion 7*a* slightly raised from an inner side portion 7*b*. End plate 7 covers the lower end opening of the hollow member 6, as shown in FIG. 10, by fitting the raised inner side portion 7*b* in the lower end opening of hollow member 6, thereby bringing outer peripheral end portion 7*a* into abutment against the outer peripheral lower end face of the hollow member 6. As a result, a communication passage 11 is formed by the lower end portion of hollow member 6 and end plate 7. Communication passage 11 feeds refrigerant chambers 8 with condensed refrigerant, which has returned into the liquid returning passages 9. As such, complete communication exists between the liquid returning passages 9, the refrigerant chambers 8, and the thermal insulation passages 10.

The radiator 4 is constructed to include a plurality of tubes 20 juxtaposed to each other, an upper tank 21 disposed over the individual tubes 20, and a lower tank 22 disposed below the individual tubes 20. A refrigerant flow control plate 23 is disposed in lower tank 22. Tubes 20 form refrigerant passages to allow refrigerant to flow between upper tank 21 and lower tank 22. Tubes 20 can be prepared, for example, by cutting a flat pipe of aluminum to a predetermined length. The pipes can then be juxtaposed to each other between the upper tank 21 and the lower tank 22.

Figure 9B:
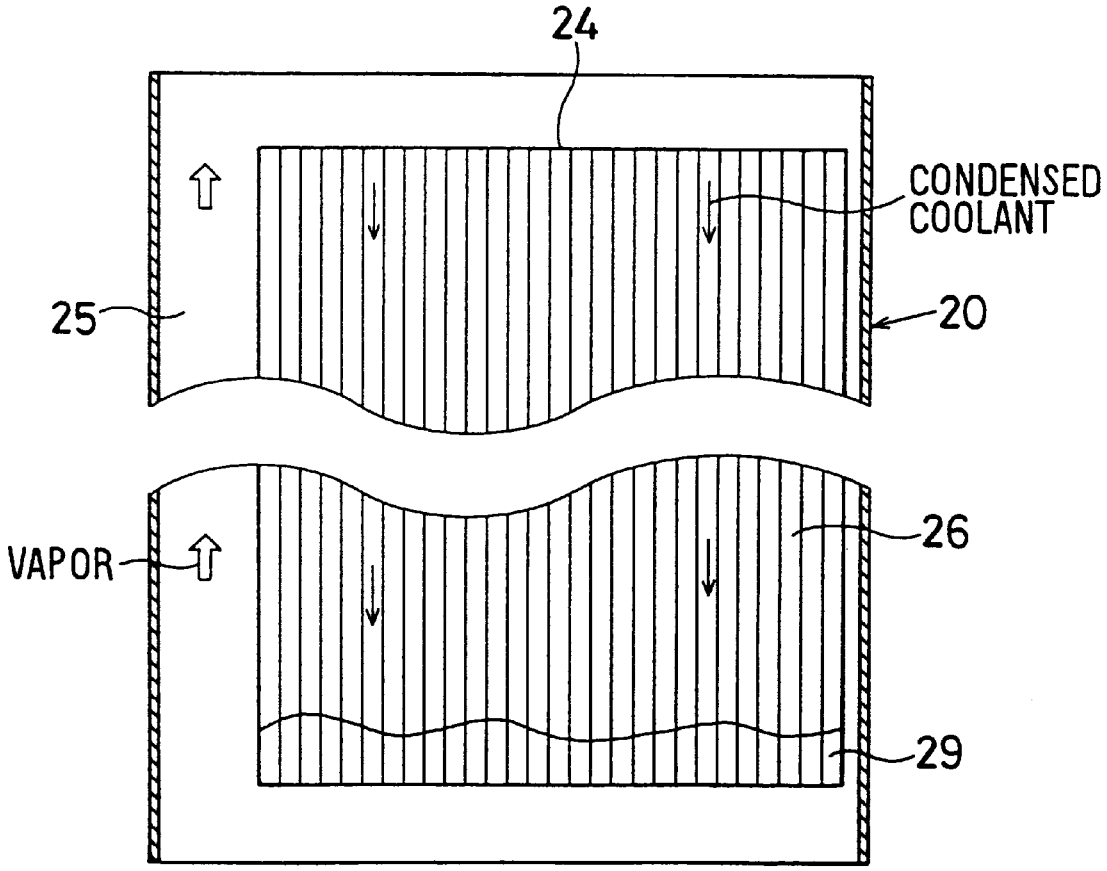
FIG. 9*b* is a top cross-sectional view along lines I—I of FIG. 9*a* of an upper tube of a boiling and cooling apparatus according to the present invention.

Into each tube 20, as shown in FIG. 9, is inserted an inner fin 24. Inner fin 24 is formed by alternately folding a thin metal sheet (e.g., an aluminum sheet) having an excellent heat conductivity at a predetermined pitch P (as referred to FIG. 9*a*) into a corrugated shape. Inner fin 24 is used to increase the condensation area in the tubes 20 and to form a (later-described) refrigerant circulating passage in tubes 20. Inner fins 24 are inserted into tubes 20 with the folded portions (or crests and valleys) extended along the passage direction (i.e., vertically in FIG. 9*b*). With respect to FIG. 9*b*, inner fin 24 is offset to the right side in the widthwise direction in tube 20, and the individual folded portions of inner tube 20 are abutted against and soldered to the inner wall of the tube 20. As a result of this offset, tubes 20 are provided with a first passage, hereinafter the "vapor passages 25", formed on the left side of inner fin 24. Also, a plurality of second passages, the "condensed liquid passages 26", are formed between the pitches of inner fins 24. The vapor passage 25 and the condensed liquid passages 26 form the aforementioned refrigerant circulating passage.

Tubes 20 are arranged with their two side faces, which bond radiation fins 24, as being in the flow direction of cooling wind which is blown in radiator 4. At this time, the tubes 20 are oriented in a direction (as referred to FIG. 6) to position vapor passages 25 downstream from the condensed liquid passages 26 with respect to the flow direction of the cooling wind.

Figure 12:
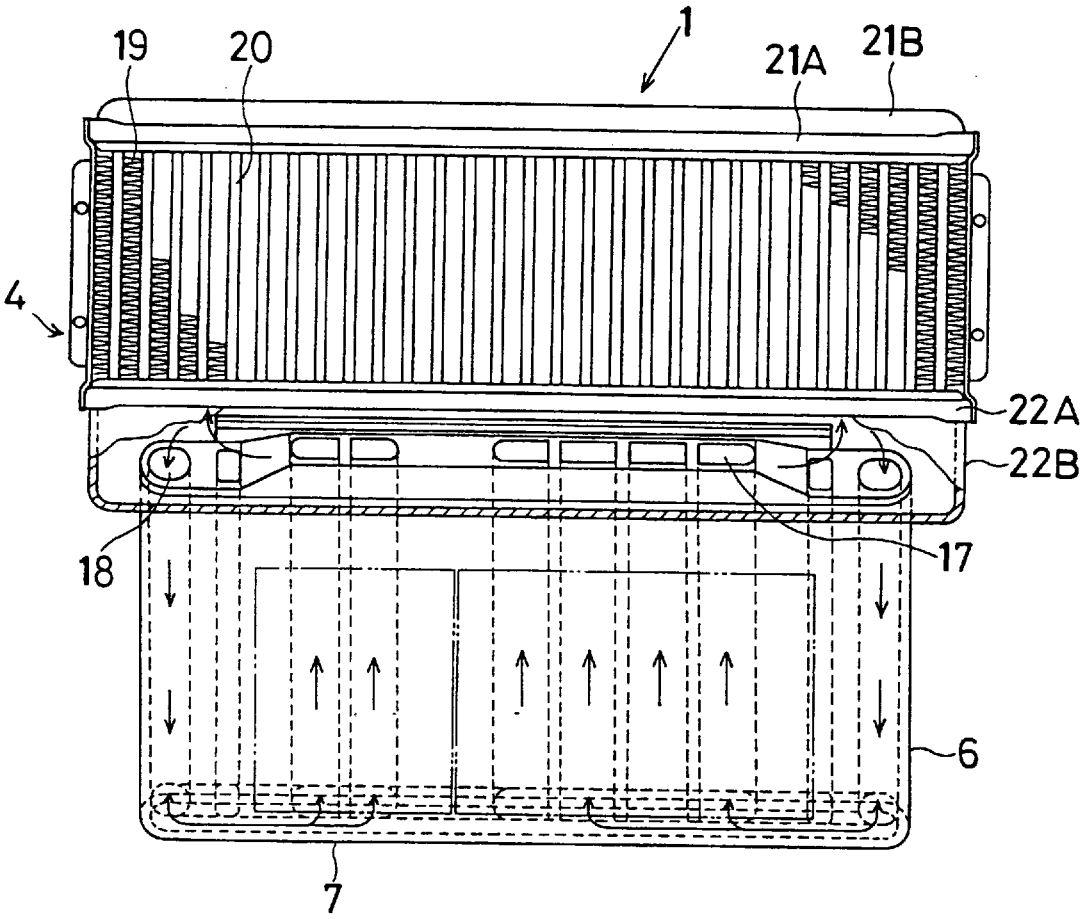
FIG. 12 is a front elevation view of a boiling and cooling apparatus according to the present invention.

The upper tank 21 is constructed by combining a core plate 21A and a tank plate 21B (see FIG. 12). The core plate 21A has a shallow dish shape and the tank plate 21B has a deep dish shape. The upper end portions of tubes 20 are individually inserted into a plurality of (not shown) slits in core plate 21A. Core plate 21A and tank plate 21B act to provide communication among the individual tubes 20 and upper tank 21.

Figure 13A:
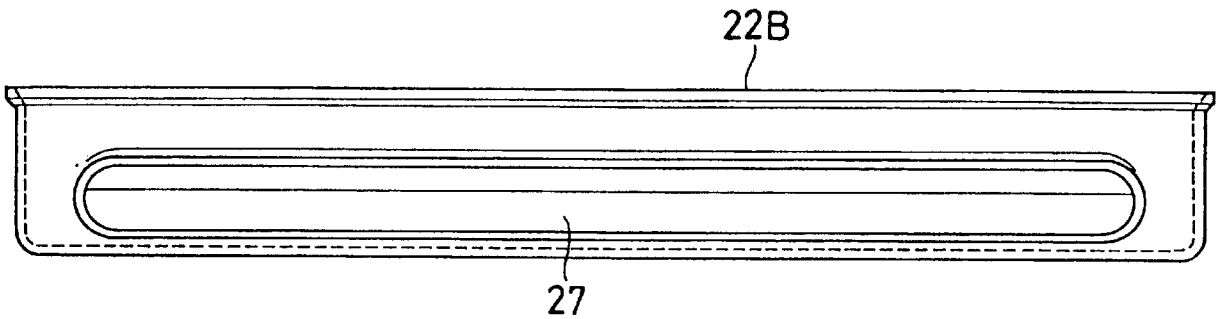
FIG. 13*a* is a front elevation view of a lower tank of a boiling and cooling device according to the present invention.
Figure 13B:
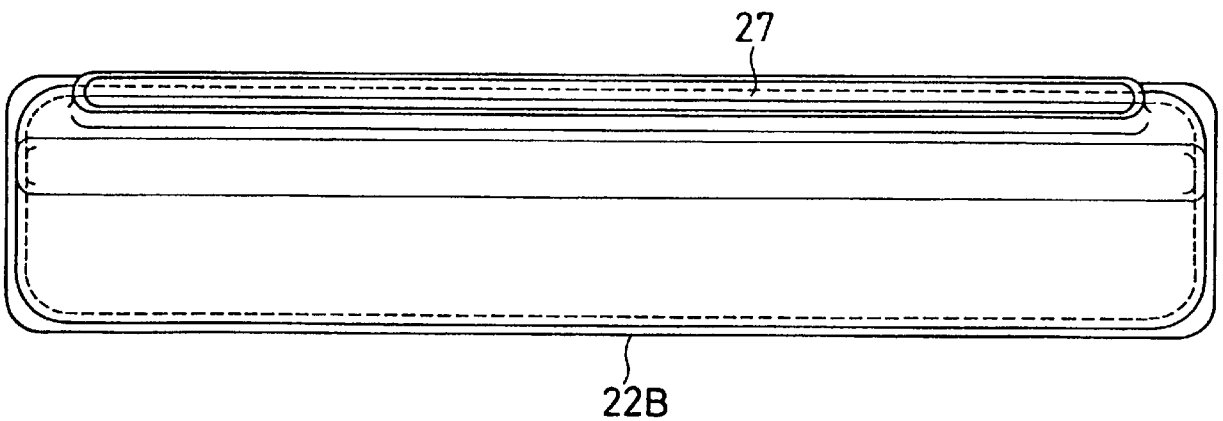
FIG. 13*b* is a side elevation view of a boiling and cooling device according to the present invention.

The lower tank 22 is constructed of a core plate 22A having a shallow dish shape and a tank plate 22B (see FIG. 13*a*, 13*b*, and 13*c*) having a deep dish shape. Again, the lower portions of the individual tubes are individually inserted into a plurality of (not-shown) slots opened in the core plate 22A. This provides communication between the individual tubes 20 and the core plate 22A. Likewise, upper end portion of the refrigerant tank 3 (or the hollow member 6) is inserted into the opening 27 formed in tank plate 22B (as referred to FIG. 6). This allows lower tank 22 to communicate with refrigerant tank 3, thereby providing communication between individual tubes 20 and refrigerant tank 3.

Figure 13C:
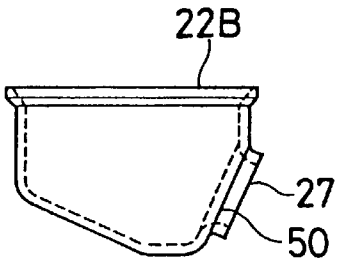
FIG. 13*c* is a top elevation view of a lower face of a boiling and cooling device according to the present invention.

As shown in FIG. 13*c*, tank plate 22B is provided with a slope 50, which has a large angle of inclination with respect to its face, which abuts core plate 22A. It is on this angled slope 50 where the aforementioned opening 27 is formed.

Referring to FIG. 6, the refrigerant tank 3 is assembled having a large inclination with respect to the lower tank 22. Refrigerant tank 3 is inserted into the opening 27 and has a boiling face, which mounts the heating body 2, being directed downward. As such, the heating body 2 is mounted on the lower side surface of the refrigerant tank such that the vapor outlets 17 may be directed obliquely upward. As a result, in lower tank 22, the lowermost portions of the vapor outlets 17 are positioned over liquid inlets 18, and vapor outlets 17 are opened as a whole over the liquid inlets 18 (as referred to FIG. 12).

Figure 14B:
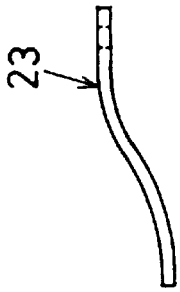
FIG. 14*b* is a front elevation of a refrigerant flow control plate for a boiling and cooling apparatus according to the present invention.
Figure 14A:
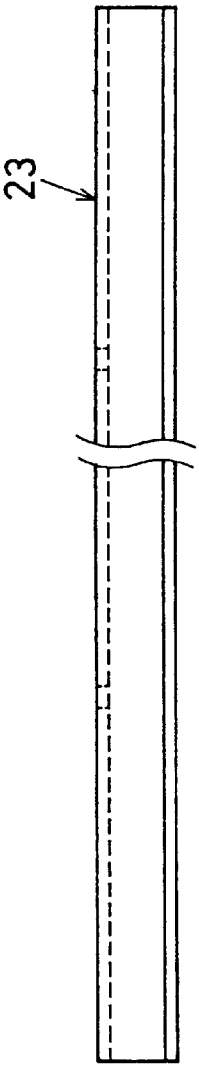
FIG. 14*a* is a side elevation view of a boiling and cooling apparatus according to the present invention.

The refrigerant flow control plate 23 (see FIG. 6) is provided for guiding the refrigerant vapor, which has exited vapor outlets 17 and preferably entering vapor passages 25 in the tubes 20. Refrigerant flow control plate 23 also serves to prevent the condensed liquid, liquefied in the tubes 20, from dropping into the vapor outlets 17. The refrigerant flow control plate 23 is mounted, as shown in FIG. 6, by screws 28 or the like on the upper end surface of the hollow member 6, which is inserted into the lower tank 22, and is arranged below the condensed liquid passages 26 formed in the tubes 20. However, the refrigerant flow control plate 23 is preferably mounted in such a gentle slope, as shown in FIG. 6, that its leading end side may be slightly higher than its mounted portion side. This refrigerant flow control plate 23 has a shape shown in FIG. 14*b*.

Referring now to FIG. 6, the operation of a first embodiment of the present invention will now be described. The liquid refrigerant in refrigerant chambers 8 is boiled by heat supplied from heating body 2. As a result of this boiling, the refrigerant vapor flows from the vapor outlets 17 into the lower tank 22. As shown in FIG. 6, the refrigerant vapor which has exited vapor outlets 17 flows in the direction of arrows along the refrigerant flow control plate 23 and mainly into the vapor passages 25 in tubes 20. The refrigerant vapor.having rising in the vapor passages 25 into upper tank 21 mainly flows into the condensed liquid passages 26. Here, it is condensed and liquefied on the surfaces of the inner fins 24 and on the inner walls of the tubes 20.

Most of the condensed liquid, as liquefied in the condensed liquid passages 26, drops into the lower tank 22. However, a portion is held in the lower portions of the inner fins 24 by the surface tension to form a liquid reservoir 29 (as referred to FIG. 9). This liquid reservoir 29 is also formed by liquid refrigerant, rising together with refrigerant vapor from vapor outlets 17. Specifically, when the radiation from heating body 2 increases, liquid refrigerant rising with vapor refrigerant impinges upon the lower surfaces of the inner fins 24. This liquid is then trapped on the lower portions of the inner fins 24 by surface tension. However, the condensed liquid in the liquid reservoir 29 of the inner fins 24, is also forced to drop sequentially from the liquid reservoir 29 into the lower tank 22 by the pressure of the refrigerant vapor rising in the vapor passages 25.

The condensed liquid, residing in the bottom portion of the lower tank 22, can flow into the liquid inlets 18 when its level exceeds the height of the lowermost portion of the liquid inlets 18. As a result, this refrigerant is able to recirculate from the liquid returning passages 9 via the communication passage 11 to the refrigerant chambers 8.

Figure 15:
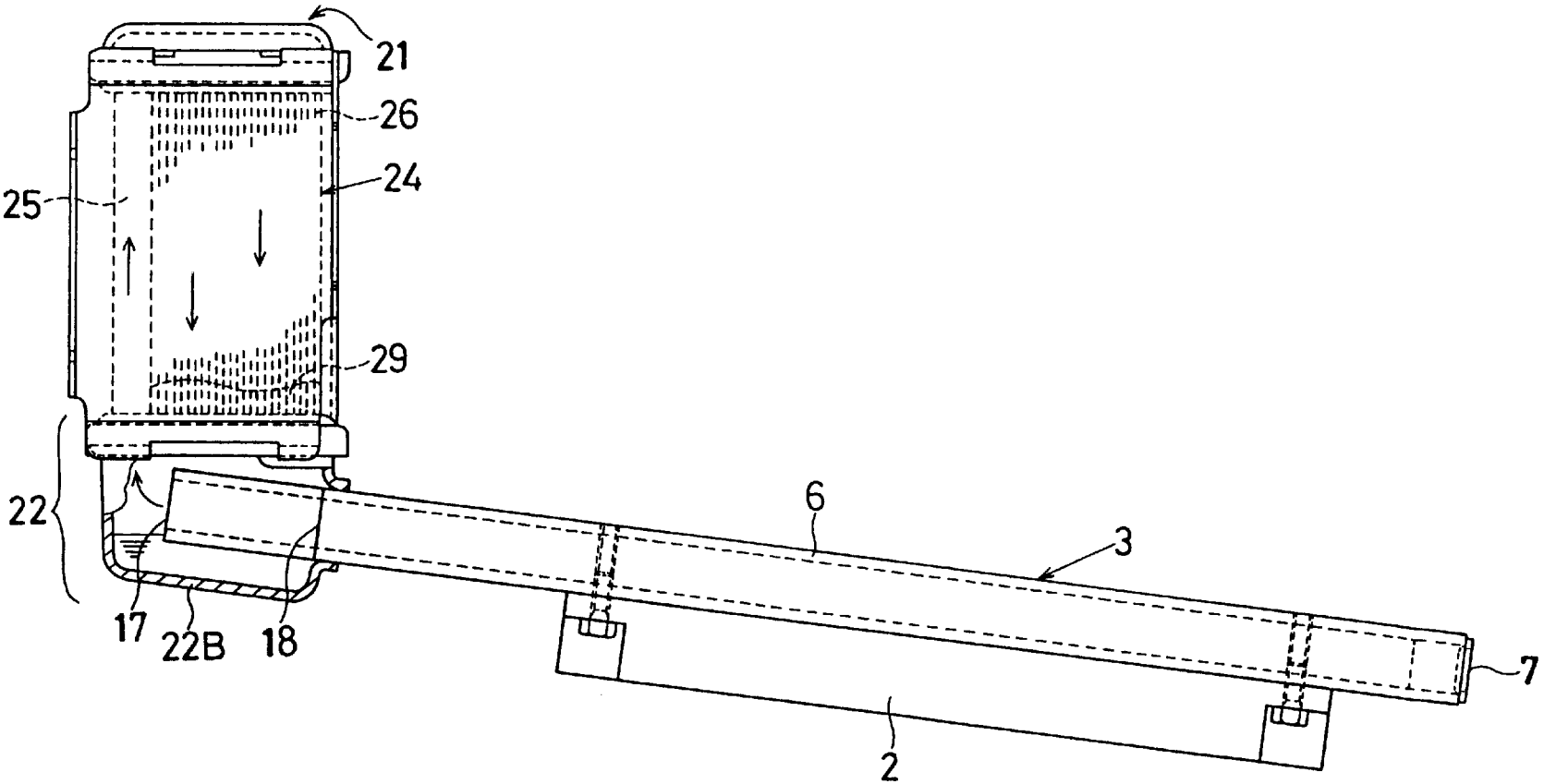
FIG. 15 is an elevation view of a radiator showing the flow of a refrigerant vapor of a boiling and cooling device according to the present invention.

Referring now to FIG. 15, a second embodiment of the present invention is shown and described. FIG. 15 shows a side elevation of the boiling and cooling apparatus 1. In this embodiment, refrigerant vapor is preferably introduced into vapor passages 25 of tubes 20 without use of refrigerant flow control plate 23. Moreover, the vapor outlets 17 of the hollow member 6 of the refrigerant tank 3 are not inclined. Instead, the portion of refrigerant tank 3 inserted into lower tank 22, is elongated such that the vapor outlets 17 fall below the vapor passages 25 in the tubes 20. As such, the opening faces of vapor outlets 17 are generally at a right angle with respect to the mounting face of the heating body 2.

Without using the refrigerant flow control plate, according to this embodiment, the refrigerant vapor exiting vapor outlets 17 preferably flows into the vapor passages 25 in tubes 20. As such, refrigerant circulation in radiator 4 is promoted as in the first embodiment, thereby improving radiation performance.

Figure 16:
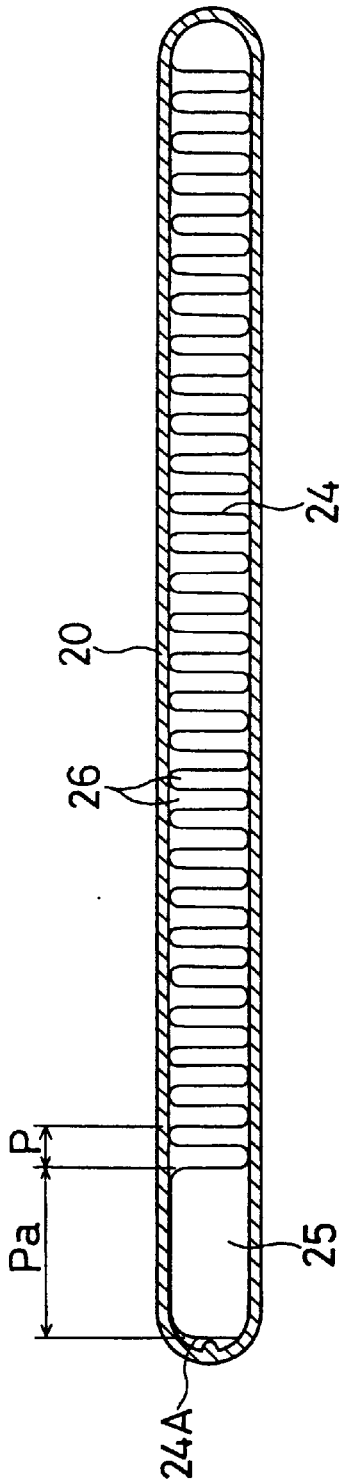
FIG. 16 is a cross-sectional view of a tube into which inner fins are inserted for a boiling and cooling device according to the present invention.

With reference to FIG. 16, a third embodiment of the present invention is shown and described. FIG. 16 illustrates a sectional view of the tube 20. In this embodiment, vapor passage 25 and condensed liquid passages 26 are formed with inner fins 24 having an unequal pitch.

At one end of inner fin 24, as shown in FIG. 16, a curved portion 24A is provided. Curved portion 24A has a larger pitch Pa, which forms the vapor passage 25 in the tube 20. By providing this section, the condensation area in tube 20 is further increased, thereby improving radiation performance. As such, the condensed liquid passages 26 and the vapor passage 25 may be formed with inner fins 24 of different pitches.

Figure 17:
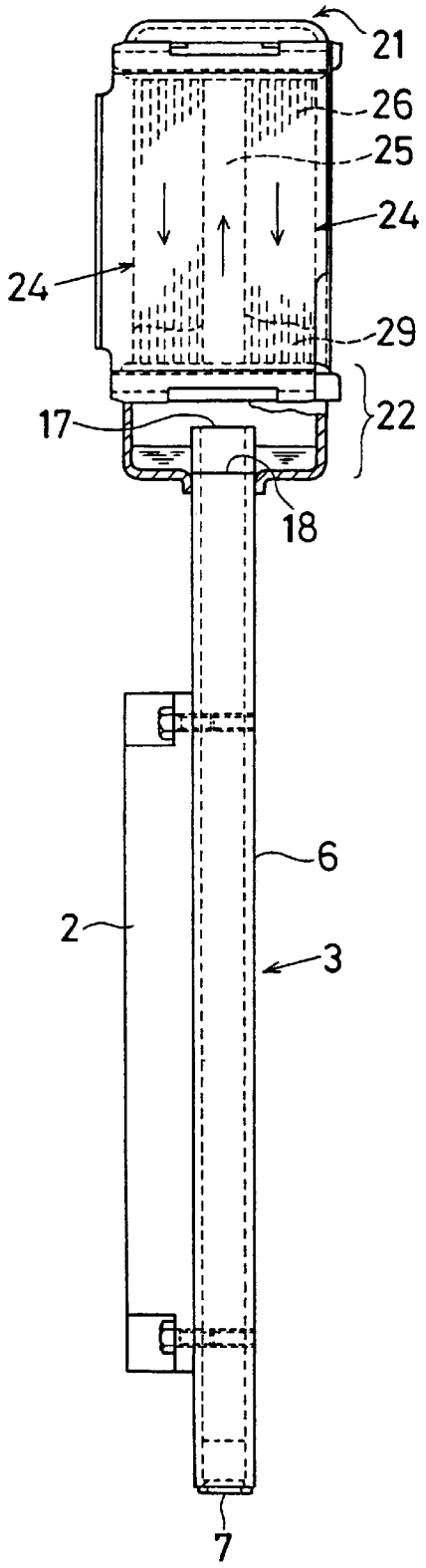
FIG. 17 is a cross-sectional view of a refrigerant tank for a boiling and cooling device according to the present invention.

Referring now to FIG. 17, a fourth embodiment of the present invention is shown and described. FIG. 17 illustrates a side elevation of the boiling and cooling apparatus 1. Here, the vapor passage 25 may be formed generally at the central portion in the tube 20. Also, the inner fins 24 are individually positioned on both sides of vapor passage 25 to form condensed liquid passages 26. The refrigerant tank 3 is arranged vertically below the vapor passage 25 so that refrigerant vapor exiting vapor outlets 17 can preferably flow into vapor passage 25 of tube 20.

Figure 19:
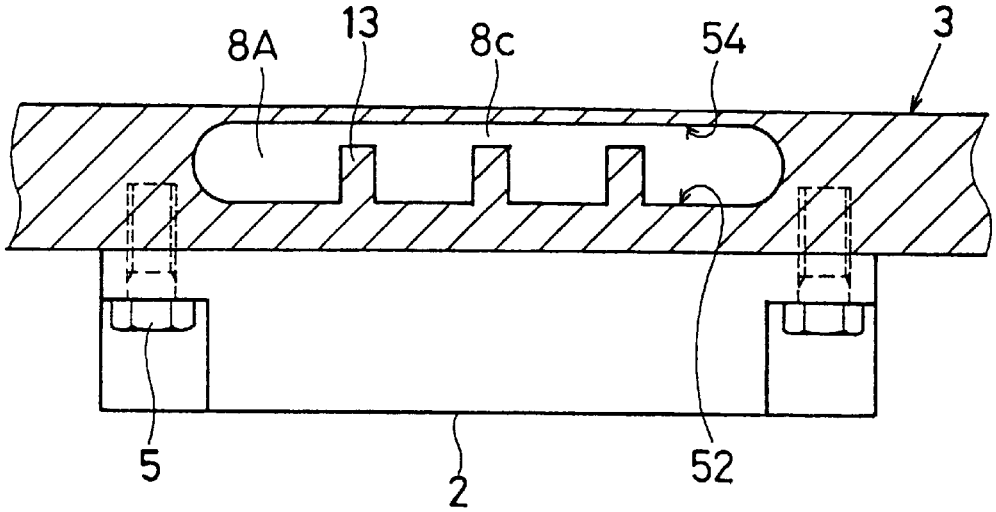
FIG. 19 is a cross-sectional view of a refrigerant passage of a boiling and cooling device according to the present invention.

In a fifth embodiment of the present invention, as shown in FIGS. 18*a*, 18*b*, and 18*c*, two refrigerant chambers 8 are juxtaposed at the central portion of hollow member 6. These chambers are individually defined into a plurality of passage-shaped spaces 8A by ribs 13. Ribs 13 protrude from inner wall 52 toward an opposite inner wall 54 (see FIG. 19), and extend lengthwise as shown along the direction of refrigerant vapor flow. To allow communication between passage shaped spaces 8A, small clearances 8*c* (See FIG. 19) are provided between the end faces of ribs 13 and opposing inner wall 54. The heating body 2 is mounted on the external surface of refrigerant tank 3, proximate inner wall 52 as shown.

As a result of this construction, the bubbling rates of each passage-shaped space 8A is different, depending upon the temperature distribution on the surface of refrigerant tank 3 from the radiation face of heating body 2. However, clearances 8*c* formed at the ends of ribs 13 provide communication between respective passage-shaped spaces 8A formed on opposite sides of ribs 13.

Figure 20A:
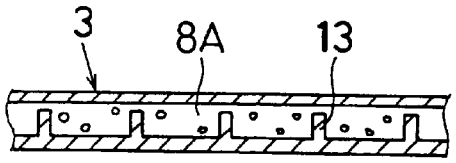
FIG. 20*a* is a front sectional view of a refrigerant tank diffusing bubbles according to the present invention.
Figure 20B:
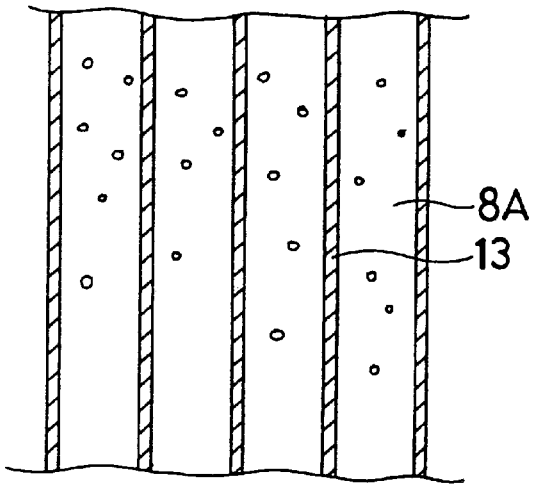
FIG. 20*b* is a side sectional view of a refrigerant tank diffusing bubbles according to the present invention.

FIGS. 20*a* and 20*b* illustrate a horizontal and vertical sectional view of refrigerant tank 3, respectively. From these views, it can be seen that the bubbles, formed in the individual passage-shaped spaces 8A, diffuse transversely across the refrigerant chambers 8 to homogenize the bubble distribution among refrigerant tank 3. As such, burnout can be prevented in passage-shaped spaces 8A having a high bubbling rate, resulting in improved burn out resistance in boiling and cooling apparatus 1.

Ribs 13 also act to increase the radiation area of refrigerant tank 3 and to enhance the rigidity of inner wall face 52, which contains ribs 13. By mounting heating body 2 on the refrigerant tank surface, outside inner wall 52, the contact heat resistance between the refrigerant tank surface and the radiation face of the heating body 2 can be reduced to improve the radiation performance.

Figure 21A:
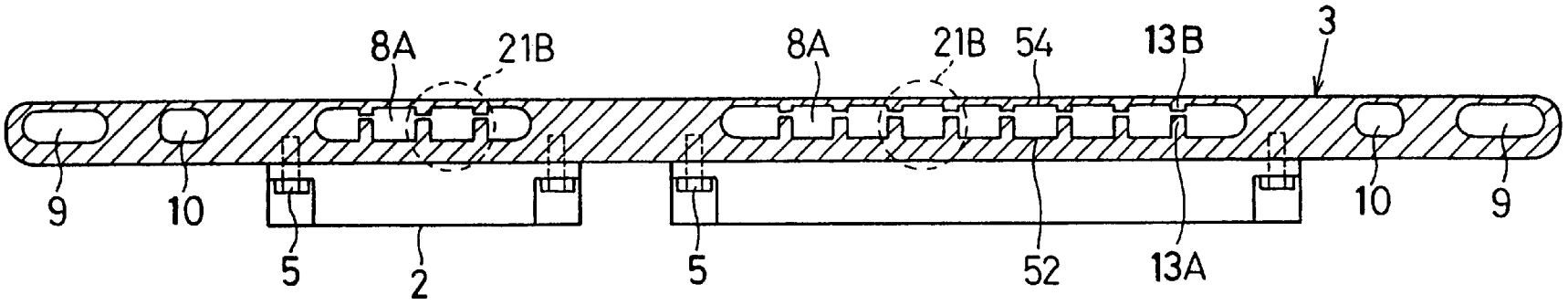
FIG. 21*a* is a front cross-sectional view of a refrigerant tank for a boiling and cooling device according to the present invention.
Figure 21B:
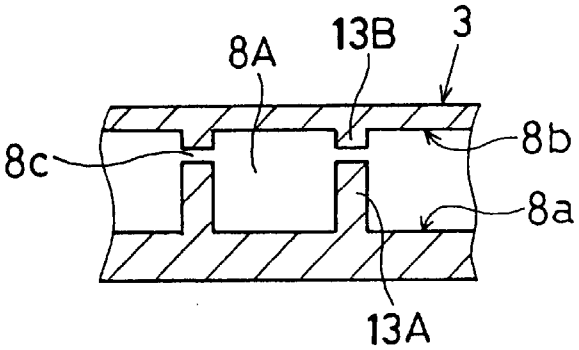
FIG. 21*b* is a partial magnified cross-sectional view of a refrigerant tank for a boiling and cooling device according to the present invention.

A sixth embodiment of the present invention is illustrated in FIGS. 21*a* and 21*b* Here, a sectional view of the refrigerant tank 3 is shown. The refrigerant tank 3 is provided with ribs 13A protruding from inner wall 52 toward the opposite inner wall 54. Ribs 13B protrude from the other inner wall 54 toward inner wall 52. Ribs 13A and ribs 13B confront each other while leaving clearances 8*c*.

According to this embodiment, communication is provided between the individual passage-shaped spaces 8A through clearances 8*c*, which are defined by ribs 13A and ribs 13B. Even if the bubbling rates are different among the individual passage-shaped spaces 8A, as in the first embodiment, the bubbles, diffuse transversely across the refrigerant chambers 8 to homogenize the bubble distribution among the refrigerant chambers 8. As a result, burnout can be prevented in the passage-shaped space 8A having a high bubbling rate. This improves the burnout resistance of the boiling and cooling apparatus 1.

Since inner walls 52 and 54 are provided with ribs 13A and 13B, respectively, the rigidity of both walls of refrigerant tank 3 are enhanced. As such, the contact heat resistance between the refrigerant tank surface and the radiation face of the heating body 2 can be reduced even if the heating body 2 is mounted on both surfaces of the refrigerant tank 3.

Figure 22A:
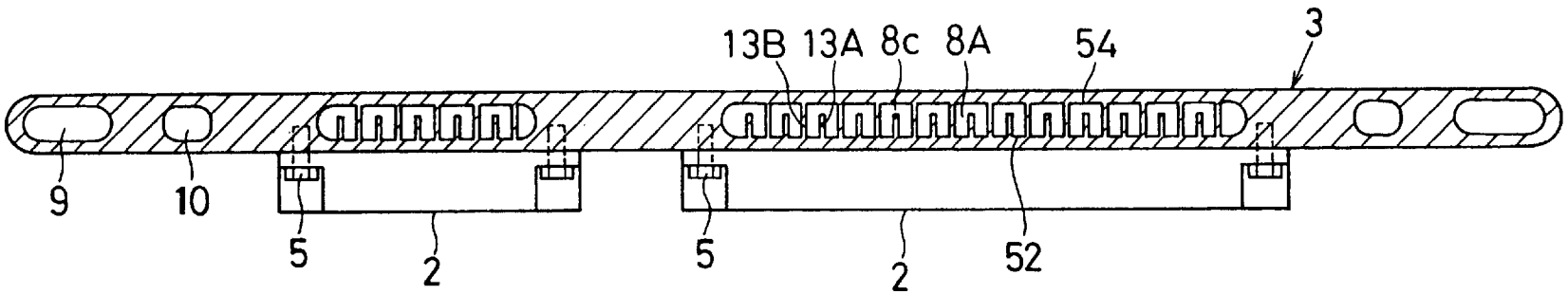
FIG. 22*a* is a front cross-sectional view of a refrigerant tank for a boiling and cooling device according to the present invention.
Figure 22B:
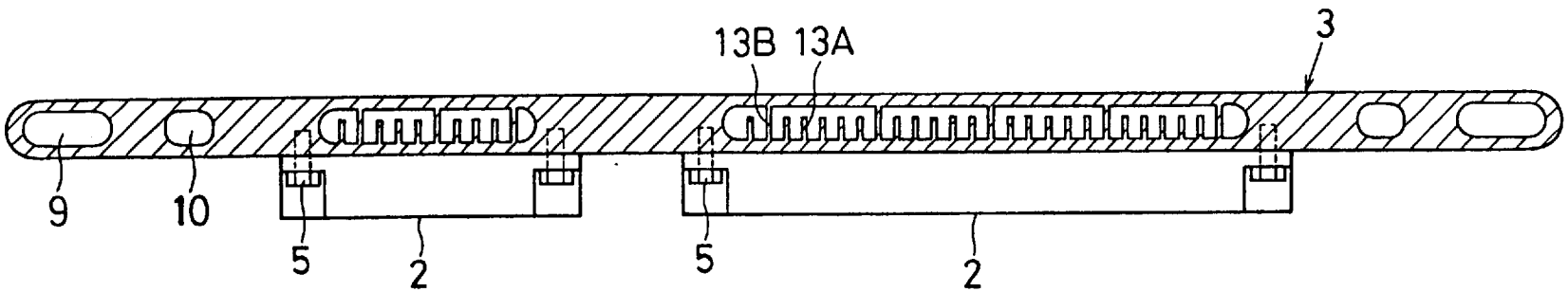
FIG. 22*b* is a front cross-sectional view of a refrigerant tank for a boiling and cooling device according to the present invention.

A seventh embodiment of the present invention, referring to FIGS. 22*a* and 22*b*, is now described. The refrigerant tank 3 of this embodiment is provided, as shown in FIG. 22*a*, with first ribs 13A protruding from inner wall 52 toward opposing inner wall 54 of the refrigerant chambers 8. Second ribs 13B join inner wall 52 with inner wall 54.

First ribs 13A are formed, as in the first embodiment, leaving the clearances 8*c* between themselves and opposing inner wall 54. As a result, passage-shaped spaces 8A, which are formed on opposite sides of first ribs 13A, are able to communicate.

Second ribs 13B are arranged alternately with respect to the first ribs 13A, to completely isolate the passage-shaped spaces 8A on the left and right sides of the second ribs 13B.

According to this embodiment, the passage-shaped spaces 8A, are made to communicate with each other through clearances 8*c* to diffuse bubbles therebetween. This, accordingly, improves burnout resistance. As compared with the case in which the ribs are constructed of only first ribs 13A, addition of the second ribs 13B improves the pressure resistance of the refrigerant tank 3 and increases the radiation area.

In this embodiment, the number of second ribs 13B may be reduced, as shown in FIG. 22*b*. Also, the second ribs 13B can be made part of the construction of the refrigerant tank 3.

Figure 23:
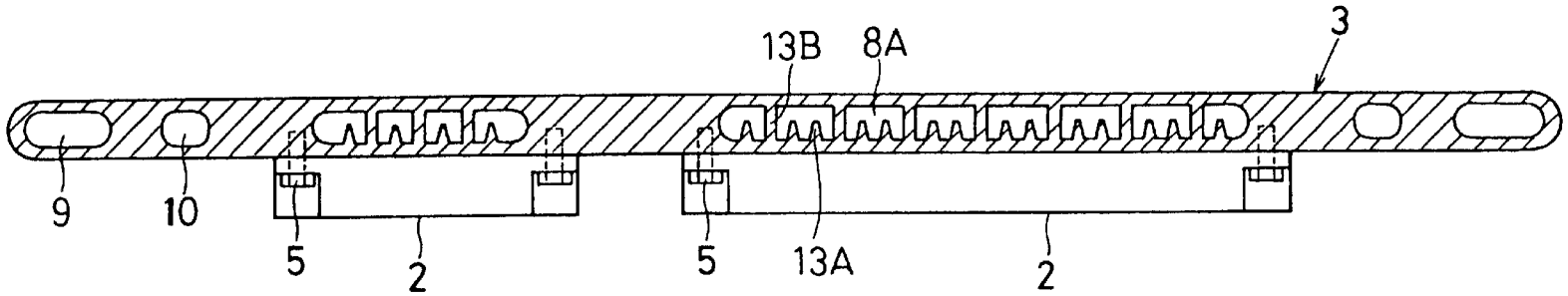
FIG. 23 is a front cross-sectional view of a refrigerant tank for a boiling and cooling device according to the present invention.

FIG. 23 illustrates a section view of the refrigerant tank 3 for an eighth embodiment of the present invention. In this embodiment, first ribs 13A are angled. The shape of ribs 13A has certain advantages with respect to rigidity and bubble flow. Specifically, the bubbles produced in the passage shaped spaces 8A are more prone to diffuse to other passage shaped spaces 8A adjacent thereto through the first ribs 13A. Also, the angled shape of these ribs helps to improve rigidity.

Figure 24:
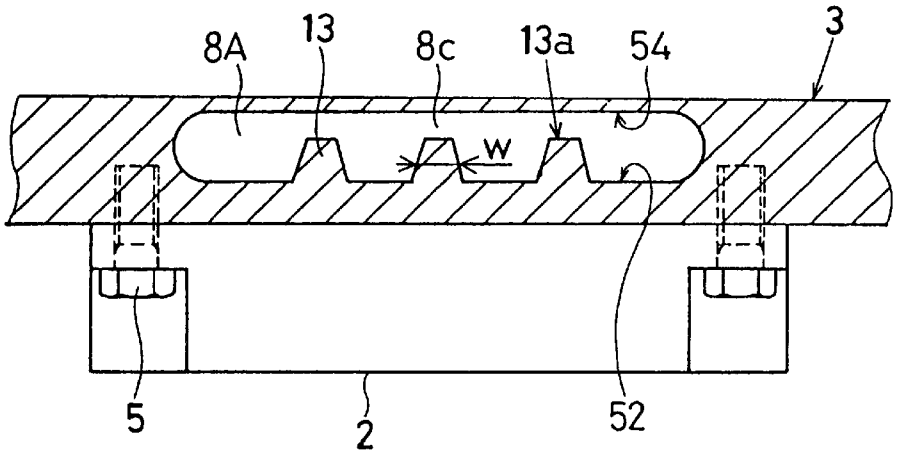
FIG. 24 is a front cross-sectional view of a refrigerant tank for a boiling and cooling device according to the present invention.

In a ninth embodiment of the present invention, as referenced in FIG. 24, ribs 13A are formed into sectionally trapezoidal shapes. As such, the width of ribs 13A gradually becomes smaller from inner wall 52, having higher radiation due to its proximity to heating body 2, toward inner wall 54 which has lower radiation. As such, the width w of ribs 13A is smaller at the lower radiation side of inner wall 54. Clearances 8*c* are provided between ribs 13A and inner wall 54, so to maintain a large sectional passage area for refrigerant vapor (or bubbles) to rise in refrigerant chambers 8. As a result, refrigerant vapor rising in refrigerant chambers 8 has little obstruction when close to inner wall 54. This results in the improvement of refrigerant circulation and prevention of burnout in refrigerant chambers 8.

Clearances 8*c* allow bubbles, produced in the individual passage-shaped spaces 8A, to diffuse through clearances 8*c* to the left and right of the refrigerant chambers 8. As a result, the bubble distribution in the refrigerant chambers 8 can be homogenized to improve burnout resistance of refrigerant tank 3.

By providing ribs 13A on inner wall 52, the rigidity of the refrigerant tank wall, on which the heating body 2 is mounted, is increased. Likewise, because of the ribs mounted proximate to heating body 2, the radiation area has improved radiation performance.

Figure 25:
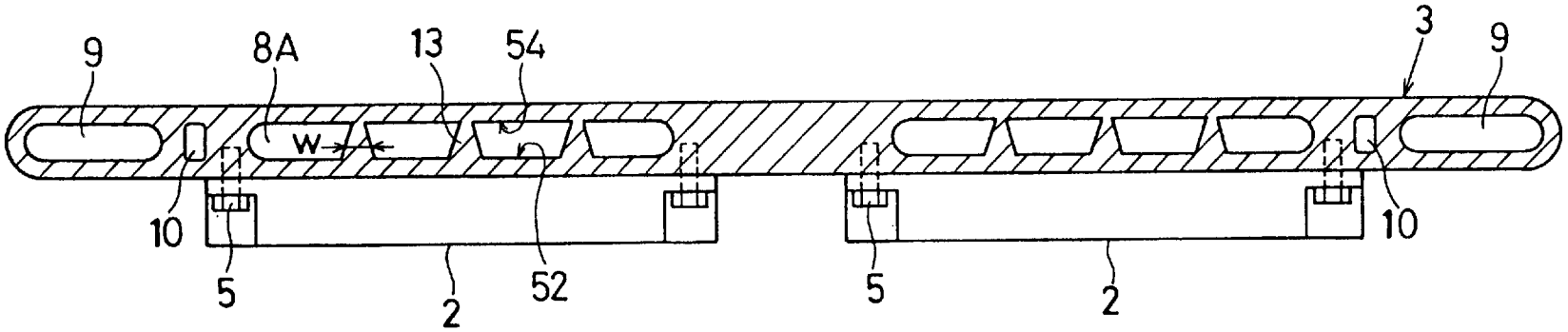
FIG. 25 is a front cross-sectional view of a refrigerant tank for a boiling and cooling device according to the present invention.

FIG. 25 is a sectional view of the refrigerant tank 3 in a tenth embodiment of the present invention. As shown in FIG. 25, ribs 13A are formed into sectionally trapezoidal shapes, such that their width w is reduced from inner wall 52 toward inner wall 54 of the refrigerant chambers 8. Moreover, protruded leading ends of ribs 13A are joined, thereby connecting inner wall 52 with inner wall 54. Because of the trapezoidal shape of ribs 13A, the sectional passage area of inner wall 54 is effectively increased. As a result, refrigerant vapor (or bubbles) are able to rise along inner wall 54. This allows the refrigerant vapor in refrigerant chambers 8 to rise without obstruction as in the first embodiment, thereby improving circulation. However, in this embodiment, inner wall 52 is joined with inner wall 54, thereby allowing ribs 13A to function as reinforcing members and enhance the pressure resistance of refrigerant tank 3.

Figure 26:
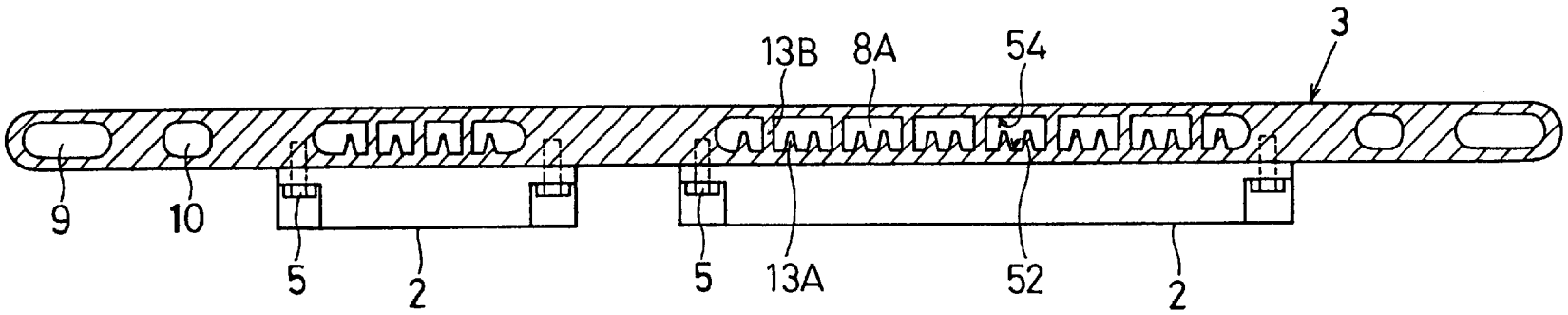
FIG. 26 is a front cross-sectional view of a refrigerant tank for a boiling and cooling device according to the present invention.

FIG. 26 is a section view of refrigerant tank 3 for a eleventh embodiment of the present invention. Refrigerant tank 3 of this embodiment is provided, as shown in FIG. 26, with first ribs 13A protruding from inner wall 52 toward inner wall 54. Second ribs 13B join inner wall 52 with inner wall 54. First ribs 13A have a gradually reducing transverse width w from inner wall 52 toward inner wall 54. Clearances 8*c* are provided to enhance refrigerant flow by allowing bubbling to flow to adjacent chambers as discussed in previous embodiments. Second ribs 13B are preferably extrusion-molded together with first ribs 13A to provide a constant transverse width.

According to this embodiment, the sectional passage area along inner wall 54, having lower radiation, is increased by virtue of first ribs 13A. By also providing second ribs 13B, the boiling face is reinforced and the pressure resistance of the refrigerant tank 3 is improved.

Figure 27A:
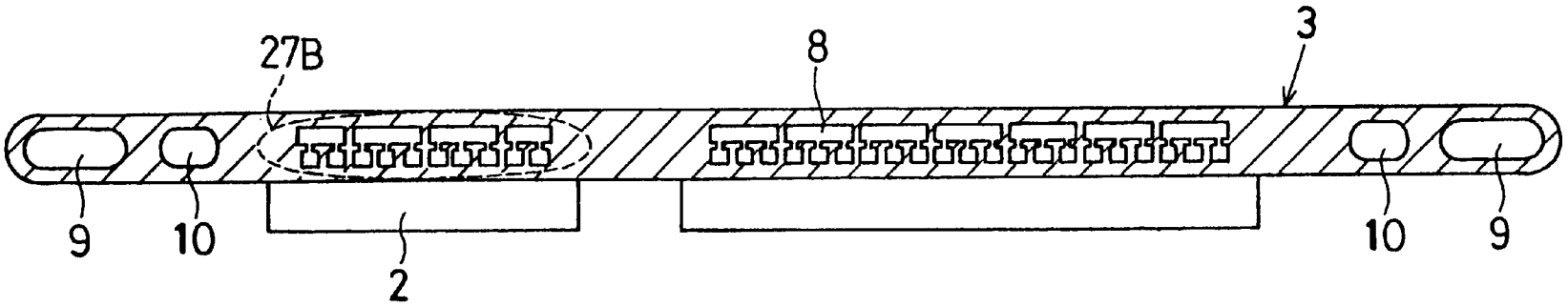
FIG. 27*a* is a front cross-sectional view of a refrigerant tank for a boiling and cooling device according to the present invention.
Figure 27B:
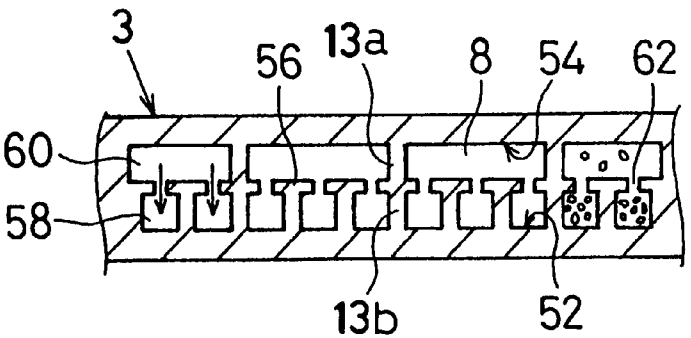
FIG. 27*b* is a partial magnified cross-sectional view of a refrigerant tank for a boiling and cooling device according to the present invention.

In the boiling and cooling apparatus according to a twelfth embodiment of the present invention, ribs 13A are positioned generally at the central portion of the refrigerant chambers 8, in the thickness direction as shown in FIG. 27*a* and FIG. 27*b*. As such, the refrigerant chambers 8 are defined by region 58 and region 60. Region 58 has a higher temperature, such that the boiling is vigorous. Region 60 has a lower temperature, such that the boiling is not as vigorous as region 58. Second ribs 13*b* are provided in the vigorous boiling region 58. As a result of this construction, the heat from heating body 2 is efficiently transferred through second ribs 13*b* and first ribs 13*a* to the ribs 56. As such, the multiple faces of the intermediate wall portions 56 are utilized as boiling faces, thereby improving radiation performance.

Since clearances 62 are provided between adjoining intermediate wall portions 56, liquid refrigerant can be stabally fed, even when radiation rises, through the clearances 62 from the lower-temperature region 60 to the higher-temperature region 58. Also, some of the bubbles, as produced in the higher-temperature region 58, can be brought to the lower-temperature region 60 so that the bubble distribution is homogenized, thereby preventing burnout of the boiling faces.

In this embodiment, second ribs 13*b* as well as first ribs 13*a* are provided which join inner wall 52 and inner wall 54 of refrigerant chambers 8. As a result, the boiling area and pressure resistance of refrigerant tank 3 are increased. Second ribs 13*b* are preferably positioned on the side of inner wall 52 to enhance the rigidity of the refrigerant tank surface, on which the heating body 2 is mounted. This acts to enhance the rigidity in this area, thereby reducing thermal contact resistance between the refrigerant tank surface and the radiation face of the heating body 2. This, in turn, results in improved radiation performance.

Figure 28A:
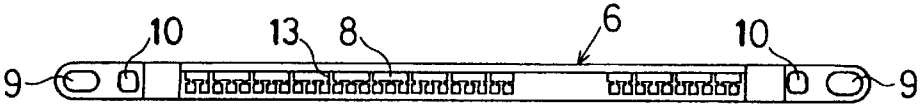
FIG. 28*a* is a front elevation view of a refrigerant tank for a boiling and cooling device according to the present invention.
Figure 28B:
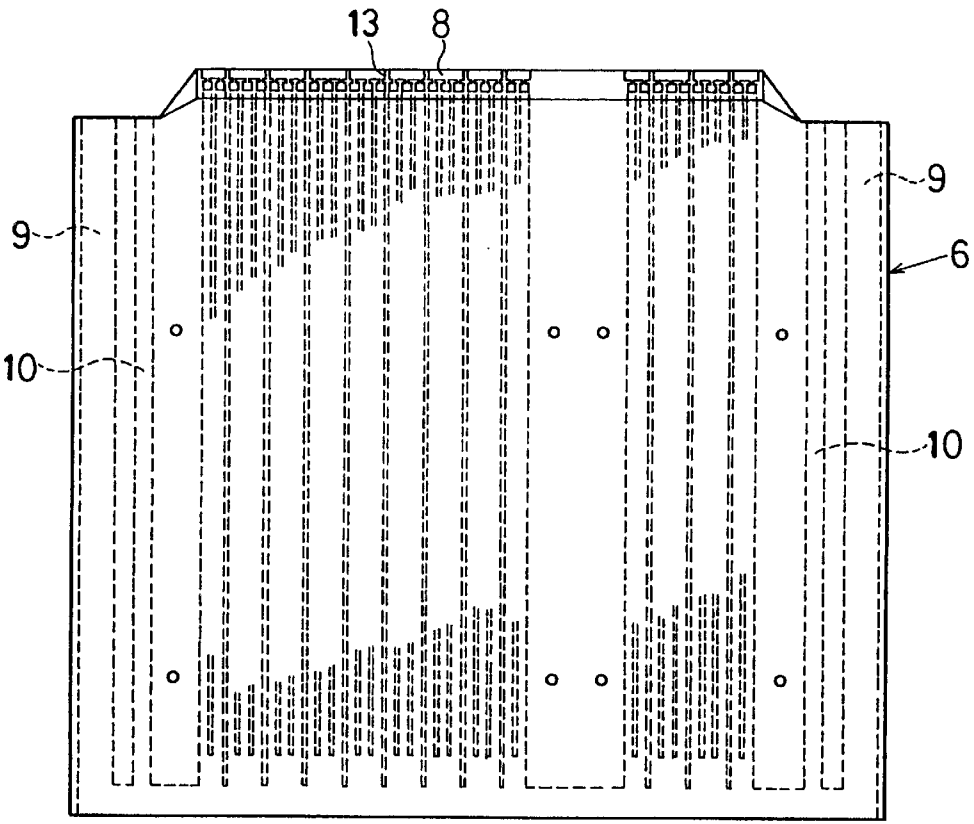
FIG. 28*b* is a top elevation view of a refrigerant tank for a boiling and cooling device according to the present invention.
Figure 28C:
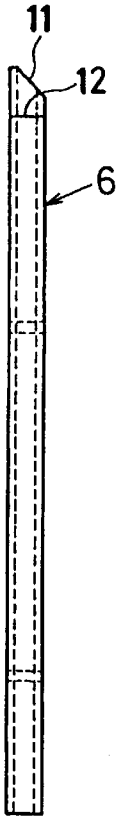
FIG. 28*c* is a side elevation view of a refrigerant tank for a boiling and cooling device according to the present invention.

By using the extrusion molding 6 in the refrigerant tank 3, it is possible to form ribs 13 (i.e., the first ribs 13*a* and the second ribs 13*b*) and the intermediate wall portions 56 in the refrigerant chambers 8. FIGS. 27*a* and 27*b* illustrate where this is done, whereas the figures depicted in FIGS. 28*a*, 28*b*, and 28*c* illustrate where ribs 13 are formed from a separate insert.

Preferably, refrigerant chambers 8 are positioned proximate the mounting range of heating body 2, and are juxtaposed at the central portion of the extrusion molding 6, as shown in FIG. 27*a*. This acts to position the ribs proximate to the heat source of heating body 2.

In a twelfth embodiment, a rib 13 (as will be described in the following) is inserted Into each of the refrigerant chambers 8. Refrigerant chambers 8 provide passages, which allow refrigerant vapor (or bubbles) to flow. A sufficient number of refrigerant chambers 8 are provided to correspond to the mounted range of heating body 2. Inner walls 64 (as referred to FIG. 30) of extrusion molding 6, which defines the boiling passages 8, provides the transfer face for transferring heat from heating body 2 to the liquid refrigerant contained therein.

Figure 31A:
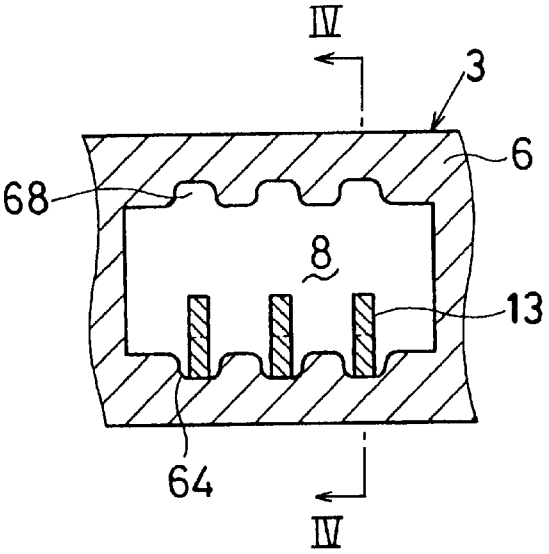
FIG. 31*a* is a partial magnified cross-sectional view of a refrigerant tank for a boiling and cooling device according to the present invention.
Figure 31B:
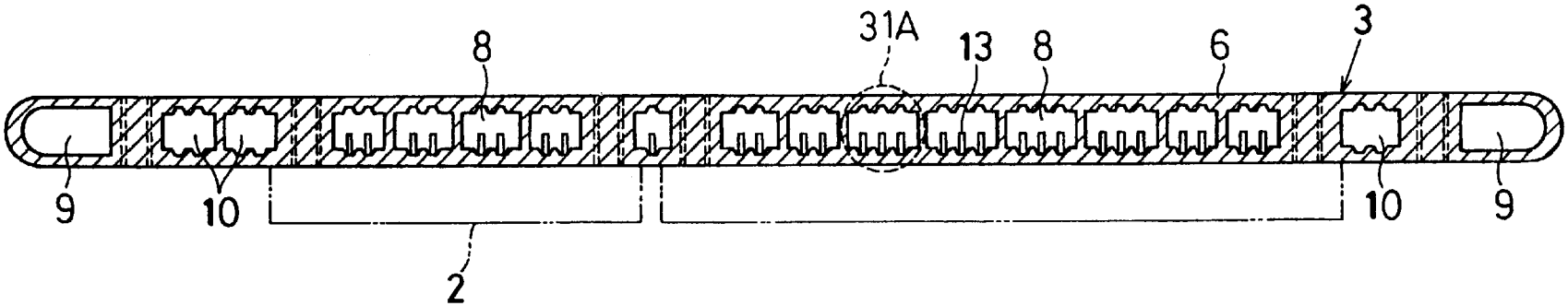
FIG. 31*b* is a front cross-sectional view of a refrigerant tank for a boiling and cooling device according to the present invention.

Ribs 13 are inserted into grooves 66, formed on the inner wall 64 of the extrusion molding 6 as shown in FIG. 31*a* and 31*b*. Here, the height of the rib 13 extends outward until reaching substantially the center of the boiling passage 8. The notches 13*a* are formed on ribs 13, on a side of ribs 13 opposite to inner wall 64 where plate members 13 are mounted. Notches 13*a* are cut away in a widthwise elongated rectangular shape in the rib 13 such that they open at an outer face of rib 13.

As shown in FIG. 29, the ribs 13 are formed into long plates, having a constant thickness t and having a plurality of notches 13*a* or other recesses positioned at substantially equal distances in the longitudinal direction. The notches 13*a* are formed on ribs 13, on a side of ribs 13 opposite to inner wall 66 where ribs 13 are mounted. Notches 13*a* are cut away in a widthwise elongated rectangular shape in the rib 13.

Notches 13*a* are formed in ribs 13 by pressing or cutting. Each opening of notches 13*a*, as shown in FIG. 29, has a width of approximately one to three times (preferably about two times) of the Laplace's length, as will be defined by the following Formula. Preferably, however, the width of notches 13*a* is two times the Laplac's length. The depth of notches 13*a* is approximately two to eight times the Laplace's length, preferably six times the Laplace's length. Wherein the Laplace's length is defined by the following equation.

$$\text{Laplace's Length}=\sqrt{\{\sigma/g(\rho^1-\rho^2)\}},$$

wherein:

$\sigma$=surface tension of liquid refrigerant;

$\rho^1$=density of liquid refrigerant;

$\rho^2$=density of vapor refrigerant; and g=gravitational acceleration.

Figure 37:
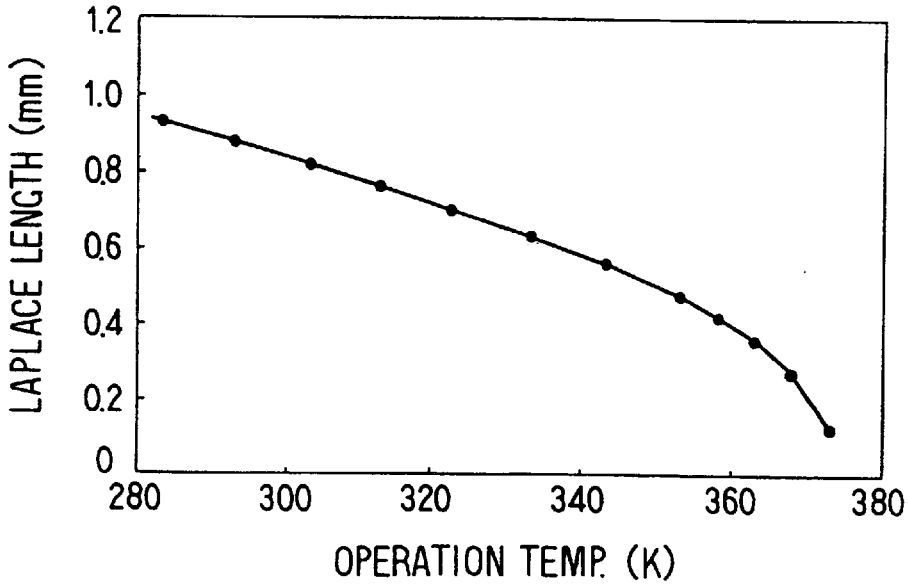
FIG. 37 is a graphical representation of the LaPlace length v. Operation Temp for a heating and cooling device according to the present invention.
Figure 36A:
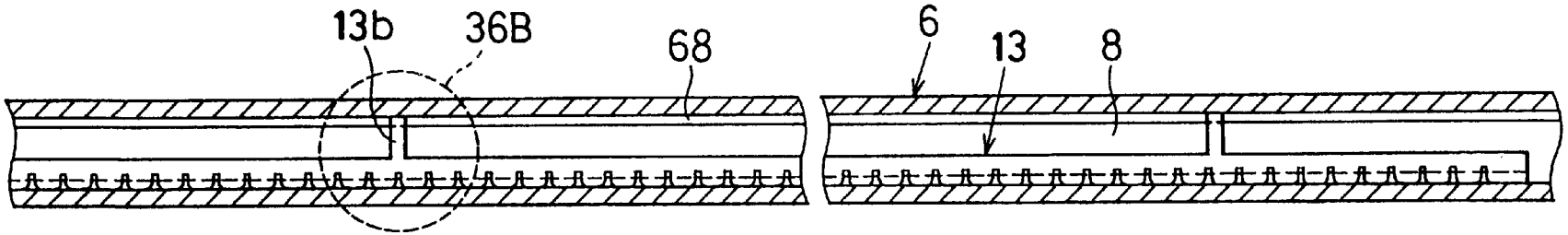
FIG. 36*a* is a side cross-sectional view of a refrigerant tank with a rib for a boiling and cooling device according to the present invention.
Figure 36B:
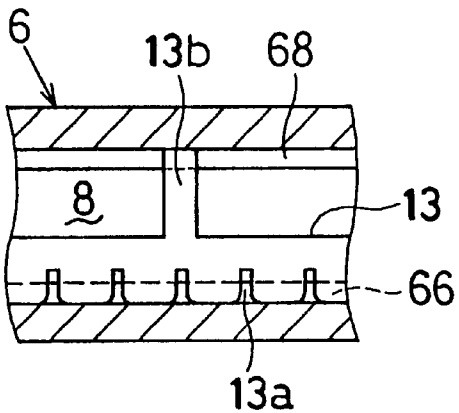
FIG. 36*b* is a partial magnified cross-sectional view of a refrigerant tank of FIG. 36*a* according to the present invention.

Here, the individual values $\sigma$, $\rho 1$ and $\rho 2$ will fluctuate as the working temperature (or the refrigerant temperature) of the boiling and cooling apparatus is different. Therefore, the Laplace's length is set to the smaller value for the higher working temperature, as illustrated in FIG. 37. If the opening width of notches 13*a* is set to this width, a thin liquid film of refrigerant is effectively formed on the surfaces of notches 13*a*. Bubbles are produced in notches 13 which improves the heat transfer rate and resulting boiling, thereby reducing overheat.

As shown in FIG. 29*a*, if the depth d of notches 13*a* is set to approximately two to eight times Laplace's length, the bubbles, which are sphered by themselves from surface tension, are not crushed. Instead, their release from the notches 13*a* is promoted. As a result, the bubbles do not reside in the notches 13*a*such that the thin liquid film can be prevented from drying out. As a result, the boiling heat transfer rate is improved, thereby preventing the boiling face from drying-out of even when heat flux increases. This maintains the desired radiation performance. Since the opening width w of the notches 13*a* is set to approximately one to three times of the Laplace's length, the notches 13*a* can be easily formed by cutting or pressing, not requiring any fine working. As a result, the radiation performance can be improved at a low cost.

When the ribs 13 are formed by pressing, clearances are left between end faces of ribs 13 and the bottom of groves 66. These grooves are formed due to a low flatness between end faces of ribs 13 and the bottoms of the grooves 66 of the extrusion molding 6. Plate members 13 are made of a cladding material of a parent metal plate which is excellent in thermal conductivity, such as aluminum, and having a solder layer on at least one of its faces. During a soldering step, the solder layer is melted, thereby filling the clearances, thereby, the contact between the extrusion molding 6 and the ribs 13 can be retained to reduce the contact heat resistance.

Figure 32A:
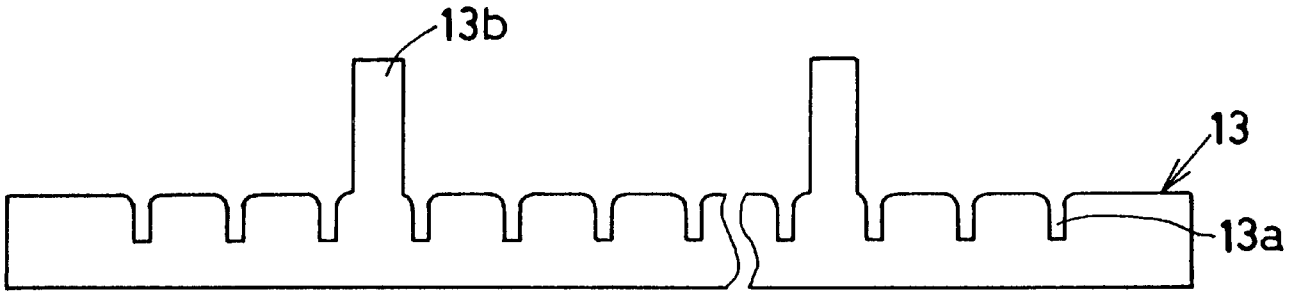
FIG. 32*a* is a side view of a rib for a boiling and cooling device according to the present invention.
Figure 32B:
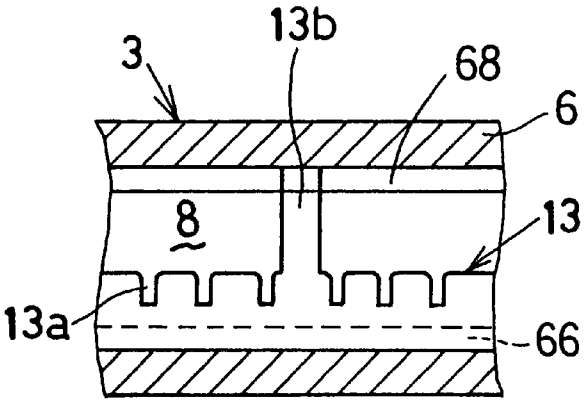
FIG. 32*b* is a partial side cross-sectional view of a refrigerant tank with a rib for a boiling and cooling device according to the present invention.

In FIGS. 32*a* and 32*b*, a thirteenth embodiment of the present invention is shown and described. Here, a top plan view of the rib 13 is shown. In this embodiment, positioning protrusions 13*b* are formed integral with the rib 13.

Figure 33:
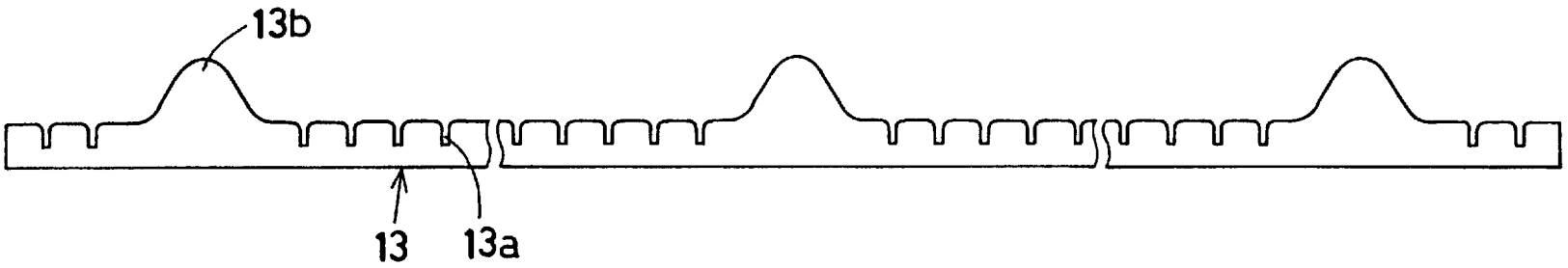
FIG. 33 is a side view of a rib for a boiling and cooling device according to the present invention.

The rib 13 is provided with a plurality of protrusions 13*b* which are so formed at a plurality of positions in the longitudinal direction. Protrusions 13*b* protrude in a rectangular shape from the widthwise end face opposite to grooves 66. Plate member 13 can be positioned on its two widthwise end portions by inserting one end portion into groove 66 and the opposing end portion, on protrusions 13*b*, into recesses 68. As a result of this positioning, rib 13 is prevented from chattering in boiling passages 8. Referring to FIG. 33, it is illustrated that protrusions 13*b* are not limited to the rectangular shape as shown in FIG. 32, but may be produced as an angle shape.

In the foregoing embodiments, the notches 13*a* (or the recesses of the invention) formed in ribs 13 are made separate from the extrusion molding 6. When the recesses of the invention are formed in the inner wall 64 of the extrusion molding 6 by the extrusion-molding method, they may be formed directly in the inner wall 64 of the extrusion molding 6. In this modification, the heat transfer face of the invention may be formed either only by inner wall 64 of the extrusion molding 6 or together with the ribs 13.

Figure 35A:
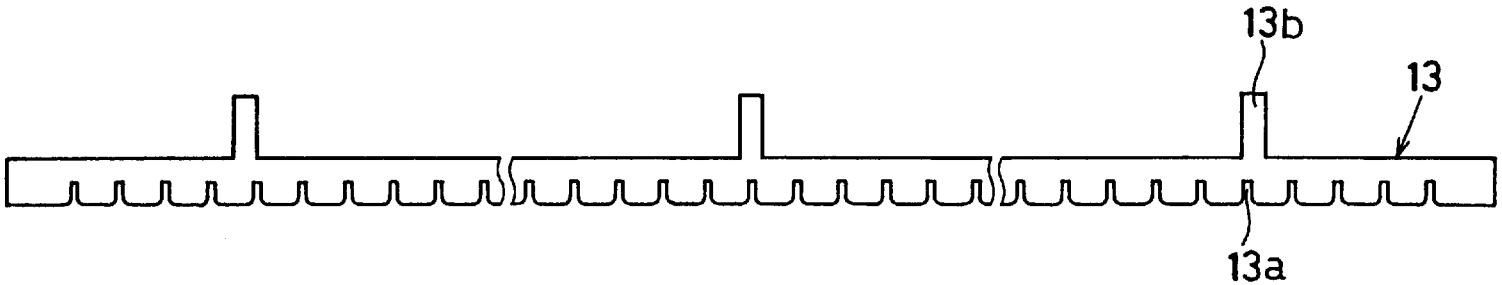
FIG. 35*a* is a side view of a rib for a boiling and cooling device according to the present invention.
Figure 35B:
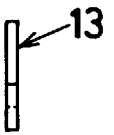
FIG. 35*b* is a front view of a rib for a boiling and cooling device according to the present invention.

FIG. 35*a* illustrates a fourteenth embodiment of the present invention. FIG. 35*a* is a top plan view of rib 13, and FIG. 35*b* is an end view of rib 13, as taken in the longitudinal direction. The rib 13 is provided, as shown in FIG. 35*a*, with a plurality of protrusions 13*b* formed at a plurality of positions along the longitudinal direction. In this embodiment, protrusions 13*b* are formed integral with rib 13. Protrusions 13*b* protrude in a rectangular shape from the side opposite notches 13*a*. This rib 13 can be positioned by its two widthwise end portions, as shown in FIG. 32. This is accomplished by inserting the side of rib 13 having notches 13*a* into a groove 66 formed in inner wall 64 of extrusion molding 6, and by inserting the leading end portions of protrusions 13*b* into recesses 68 formed in inner wall 64. As a result, the rib 13 is prevented from chattering in the boiling passages 8.

As in the previous embodiment, the protrusions 13*b* of the rib 13 need not be limited to the rectangular shape shown in FIG. 35, but may be exemplified by an angle shape, as shown in FIG. 33.

Figure 34:
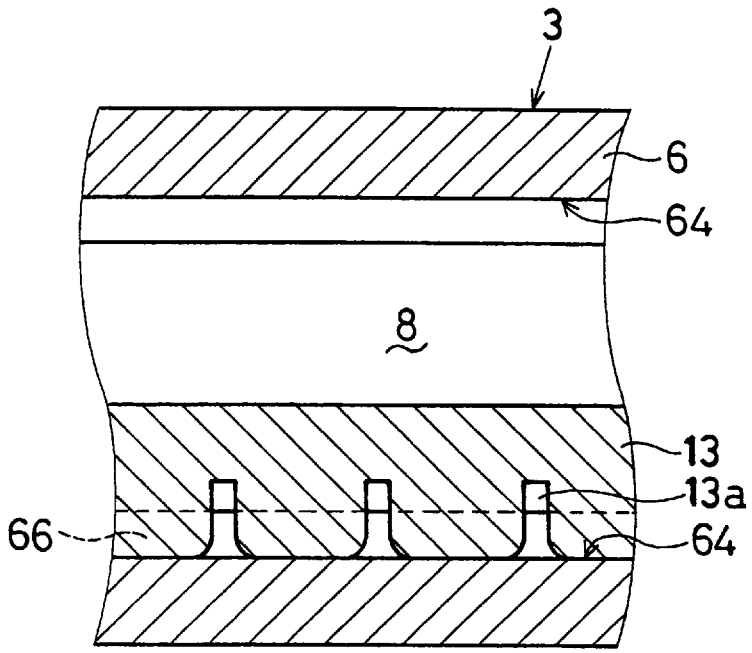
FIG. 34 is a partial side cross-sectional view of a refrigerant tank with a rib for a boiling and cooling device according to the present invention.

In this embodiment, the effective boiling area of each of the boiling passages 8 is increased by arranging the ribs 13 in contact with inner wall 64 and by providing the plurality of notches 13*a* in ribs 13. As a result, even when the thermal load and heat flux increase, the overheat is reduced to prevent drying-out of the boiling faces. This, in turn, improves radiation performance. Moreover, ribs 13 are arranged to direct openings of notches 13*a* toward inner wall 64, as shown in FIG. 34. As such, the radiation area is increased close to the inner wall 64 of the extrusion molding 6, the temperature of which is raised by the heat of the heating body 2.

As in the previous embodiment, when the ribs 13 are formed by pressing, clearances are left between end faces of ribs 13 and bottoms of grooves 66. This is due to the low flatness of the respective end faces. If a cladding material is used for the ribs 13, the solder material of the cladding material melts during the soldering step. The solder then flows into the clearances between the end faces of the ribs 13 and the bottoms of the grooves 66, thereby filing up the clearances. As a result, the contact between the extrusion molding 6 and the ribs 13 is retained, thereby reducing heat resistance.

Figure 39:
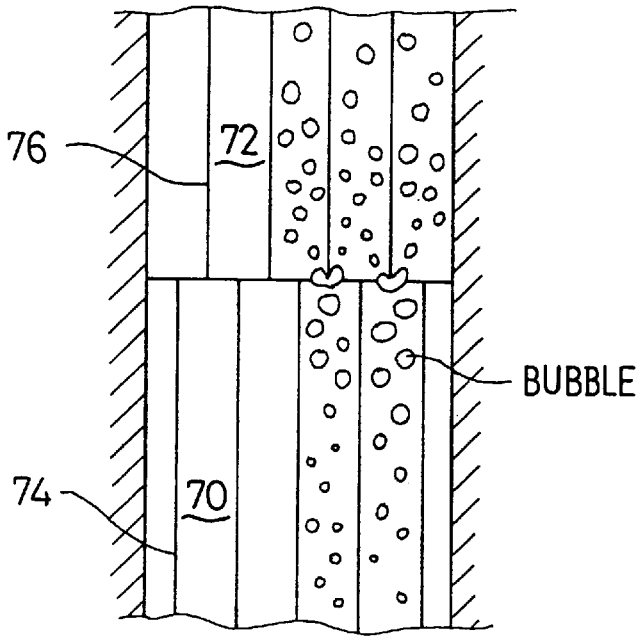
FIG. 39 is a top cross-sectional view of a refrigerant tank for a boiling and cooling device according to the present invention.
Figure 40:
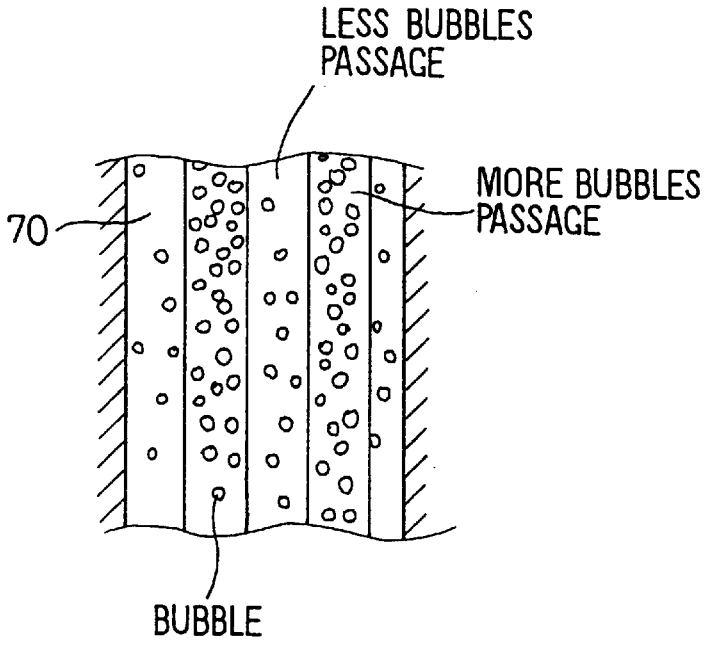
FIG. 40 is a cross-sectional view showing a plurality of refrigerant bubbles.

In a fifteenth embodiment of the present invention, as depicted in FIG. 39, the refrigerant tank has lower passage portions 70 and an upper passage portions 72. Lower passage portions 70 are defined by lower corrugated fins 74, arranged to correspond to the lower sides of the boiling faces. Likewise, upper passage portions 72 are defined by the upper corrugated fins 76, and are arranged to correspond to the upper sides of the boiling faces. Lower corrugated fins 74 and upper corrugated fins 76 are transversely staggered in communication with each other. For instance, in FIG. 39, one lower passage portion 70 is shown communicating, at its upper end, with two upper passage portions 72. As such, bubbles rising in the lower passage portion 70, as depicted in FIG. 40, can advance separately into the two separate passage portions 70 and 72, as depicted in FIG. 39.

Corrugated fins 82 are folded into corrugated shapes to increase the boiling surface area in the refrigerant tank 3. Lower corrugated fins 74 are arranged to correspond to a lower portion of the boiling face of heating body 2, distal from radiator 4. Upper corrugated fins 76 are arranged to correspond to the upper sides of the boiling face of heating body 2, proximate heating body 2. Lower and upper corrugated fins 74 and 76, respectively, are individually held in thermal contact with the boiling faces of the refrigerant chambers 8.

Figure 1:
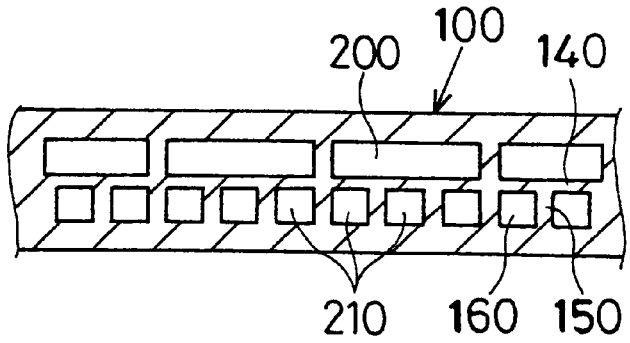
FIG. 1 is a cross-sectional view of the refrigerant tank according of the prior art.
Figure 2:
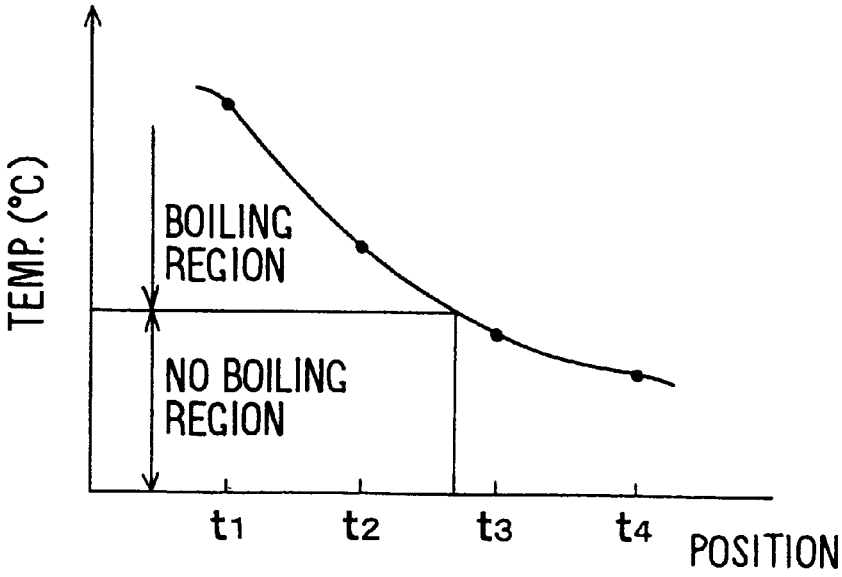
FIG. 2 is a graphical representation of the heat absorption characteristics of a boiling and cooling device according to the prior art.
Figure 3:
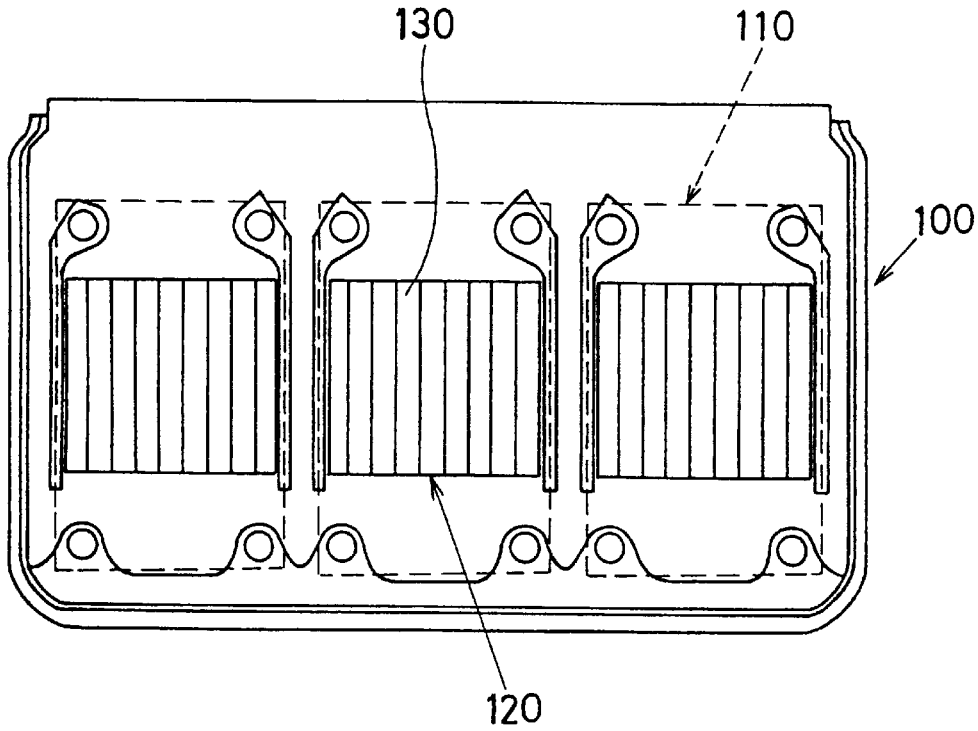
FIG. 3 is a plan view illustrating the inside of a refrigerant tank of a boiling and cooling device according to the prior art.
Figure 4:
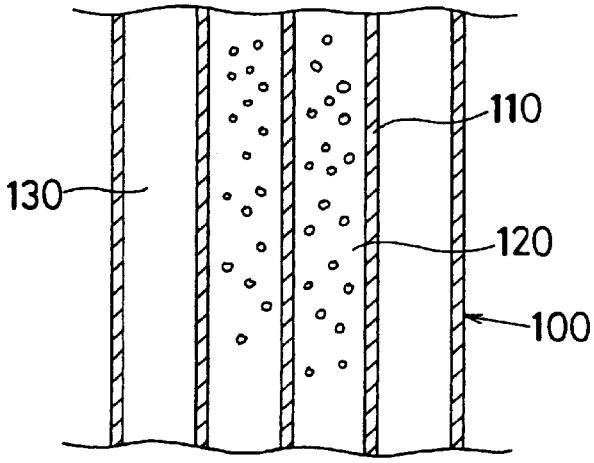
FIG. 4 is atop cross-sectional view of a refrigerant tank illustrating a bubbling state of a boiling and cooling device according to the prior art.
Figure 5:
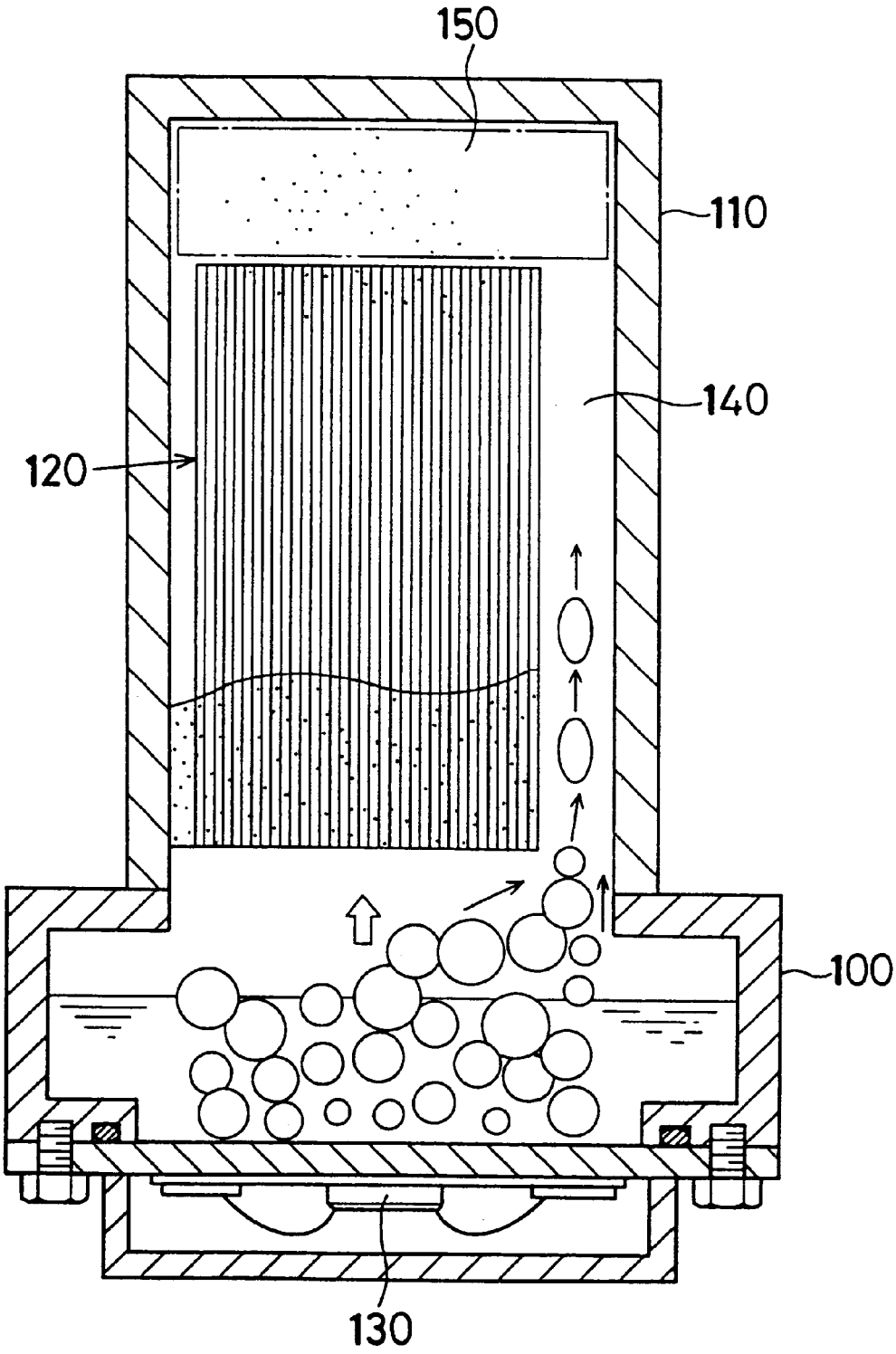
FIG. 5 is a cross-sectional view of a boiling and cooling apparatus according to the prior art.
Figure 44A:
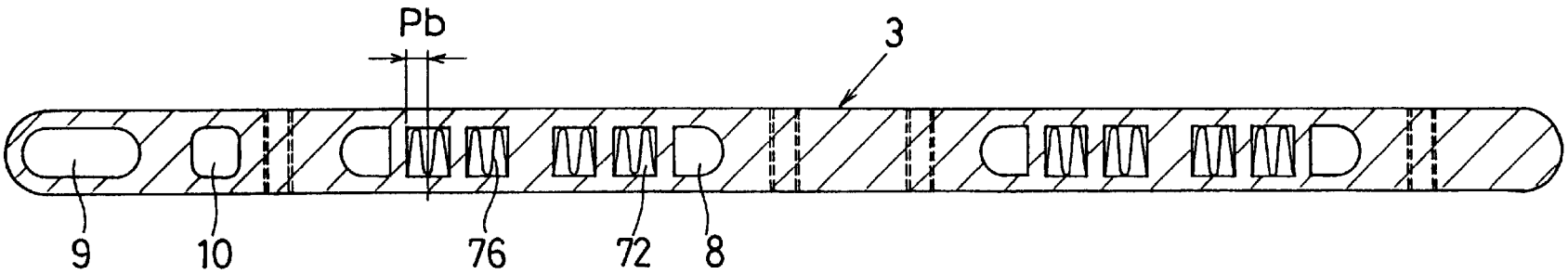
FIG. 44*a* is a cross-sectional view along plane V—V of a refrigerant tank of FIG. 41 for a boiling and cooling device according to the present invention.
Figure 44B:
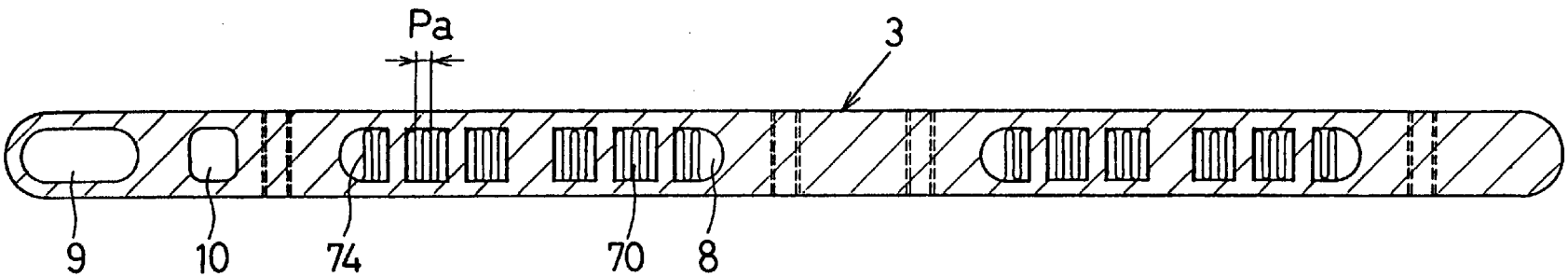
FIG. 44*b* is a cross-sectional view along plane VII—VII of a refrigerant tank of FIG. 41 for a boiling and cooling device according to the present invention.

Lower corrugated fins 74 and upper corrugated fins 76 are individually positioned in the longitudinal direction along refrigerant tank 3. Moreover, lower corrugated fins 74 and upper corrugated fins 76 have a common fin pitch P to partition the individual refrigerant chambers 8 further into a plurality of narrow passage portions. As illustrated in FIG. 44*a* and 44*b*, lower corrugated fins 74 and upper corrugated fins 76 are positioned within refrigerant chambers 8 such that their crests and valleys are staggered in the transverse direction (horizontally across FIG. 3*b*). Specifically, the lower corrugated fins 74 and the upper corrugated fins 76 are so inserted into the individual passages that their back-and-forth directions are inverted each other (vertically of FIGS. 44*a* and 44*b*).

The advantage of such a system is illustrated in FIG. 39. If some of the lower passage portions 70 have many bubbles, whereas others have few, the bubbles rising in the individual lower passage portions 70 are individually scattered to advance into the two upper passage portions 72. This results in their quantity being substantially homogenized in the individual upper passage portions 72. Even if the bubbles rising in the lower passage portions 70 join together and grow into larger ones, it is highly probable that they will impact and split apart, when they advance into the upper passage portions 72. As illustrated in FIG. 39, this impact occurs against the lower ends of the upper corrugated fins 76. As a result, the bubbles rising in the lower passage portions 70 are more homogeneously dispersed to advance into the upper passage portions 72. Thus, the distribution of bubbles in the individual upper passage portions 72 is substantially homogenized, thereby filling the boiling faces more stabally with the refrigerant. As such, burnout is not as likely to occur, especially over the boiling faces where the number of bubbles increases.

Figure 41:
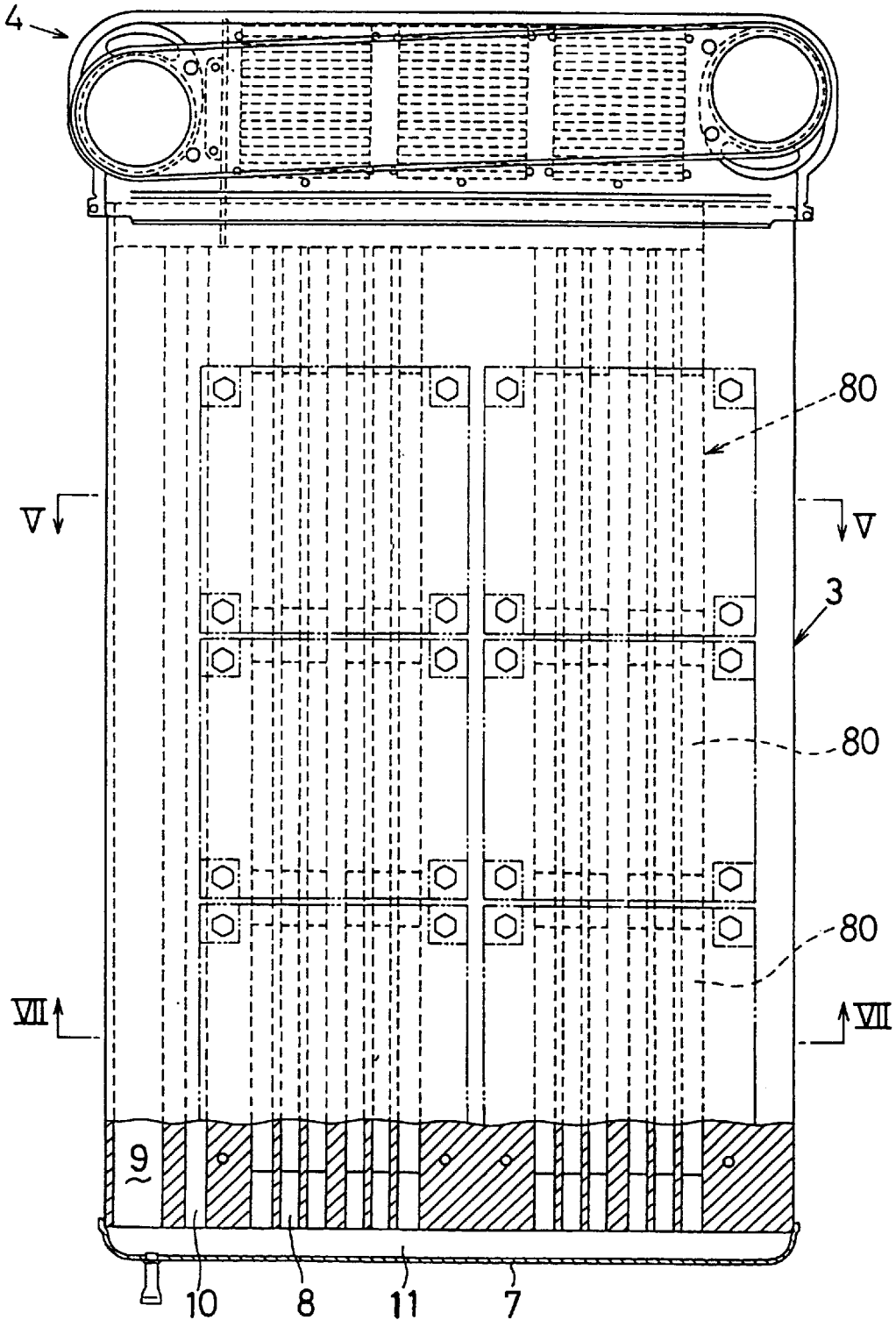
FIG. 41 is a top plan view of a boiling and cooling device according to the present invention.

FIG. 41 is a plan view of a cooling apparatus 1, according to an sixteenth embodiment of the present invention. In this embodiment, the corrugated fins 82 are arranged at individual positions corresponding to the lower, intermediate and upper portions of the boiling faces of the refrigerant tank 3. The individual corrugated fins 82 are given an identical fin pitch and are inserted vertically in the individual passages of the refrigerant chambers 8 as in the first embodiment. However, individual corrugated fins 82 are not arranged vertically in contact with each other, but a predetermined space 80 is retained between each set of lower corrugated fins and each set of upper corrugated fins. Such an arrangement is illustrated in FIG. 42.

Figure 42:
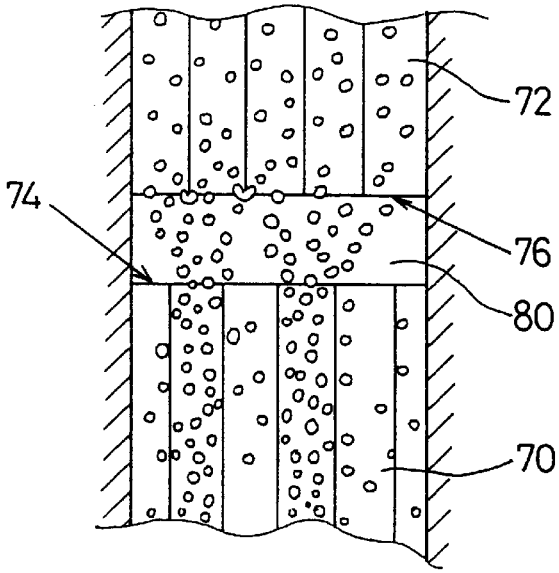
FIG. 42 is a cross-sectional view of a portion of a refrigerant tank of a boiling and cooling device according to the present invention.

Referring to FIGS. 41 and 42, the relationship between the lower, intermediate and upper corrugated fins 82 is now described. It is noted that the lowermost corrugated fins 82 are those located distal from radiator 4, while the upper corrugated fins 82 are proximate radiator 4, and the intermediate corrugated fins 82 reside therebetween. The lowermost corrugated fins 82 and the intermediate corrugated fins 80 in FIG. 41 are depicted in FIG. 42 as the lower corrugated fins 74 and upper corrugated fins 76 respectively. Likewise, the intermediate corrugated fins and the upper corrugated fins in FIG. 41 are depicted in FIG. 42 as, once again, the lower corrugated fins 74 and upper corrugated fins 76 respectively.

In this embodiment, the bubbles which have risen in the lower passage portions 70, are horizontally scattered in spaces 20. Spaces 20 allow passages to scatter and homogenize these bubbles. As such, many bubbles contained in lower passage portions 70, can be scattered in spaces 20 and advanced into upper passage portions 72, thereby homogenizing their quantity in individual upper passage portions 72.

Once again, even if the bubbles rising in the lower passage portions 70 join together and grow into larger ones, it is highly probable that they will impact and split apart, when they advance into the upper passage portions 72. As illustrated in FIG. 42, this impact occurs against the lower ends of the upper corrugated fins 76. As a result, the bubbles rising in the lower passage portions 70 are more homogeneously dispersed to advance into the upper passage portions 72. Thus, the distribution of bubbles in the individual upper passage portions 72 is substantially homogenized, thereby filling the boiling faces more stabally with the refrigerant. As such, burnout is not as likely to occur especially over the boiling faces where the number of bubbles increases.

Furthermore, in this embodiment, it is preferable to position space 20 vertically away from higher temperature areas (e.g., computer chip) of heating body 2 and, instead, arranging corrugated fins 82 beneath the heating portion. If space 20 is positioned over a higher temperature area, the effectiveness of the cooling system is reduced.

In a seventeenth embodiment of the present invention, a third set of corrugated fins are additionally arranged in space 80. Fins positioned within space 80 preferably have a larger fin pitch than lower corrugated fins 74 and upper corrugated fins 76. These fins act to further disperse bubbles rising from lower passage portions 72.

Lower corrugated fins 74 and upper corrugated fins 76 do not need to be horizontally staggered. Instead, they may be in line. This is due to the addition of fins 82 positioned in space 20. However, if desired, lower and upper corrugated fins 74 and 76 may be staggered.

Figure 43:
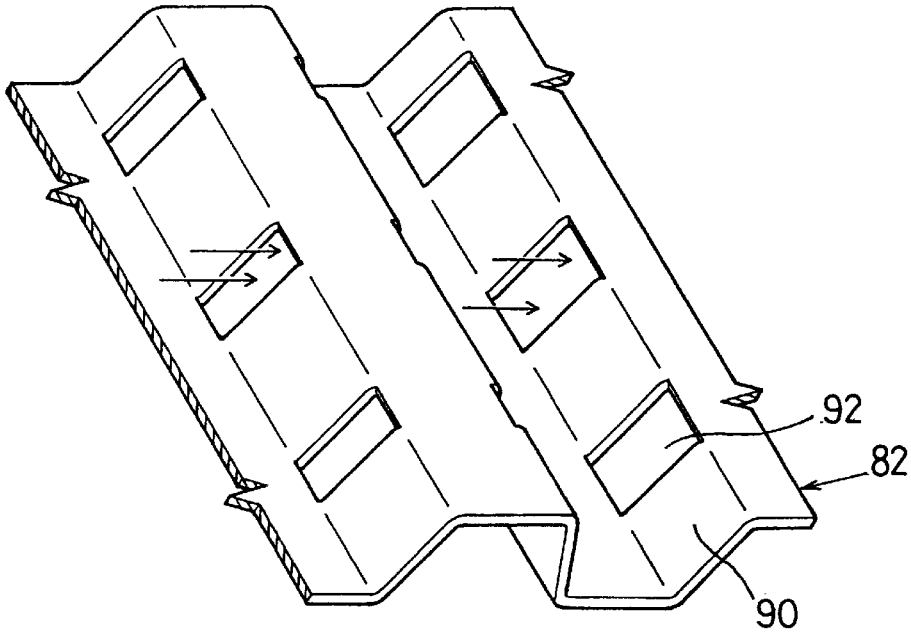
FIG. 43 is a perspective view of a rib for a boiling and cooling device according to the present invention.

FIG. 43 is a perspective view of corrugated fins 82 according to an eighteenth embodiment of the present invention. In this embodiment, openings 92 are formed in the side faces 90 of the corrugated fins 82, thereby defining these as passage portions. In this case, corrugated fins 82, as illustrated allow each adjoined passage portion to communicate through side faces 92 such that rising bubbles in one passage portion are able to advance into the adjacent passage portion. As a result, the bubble distributions in the individual passage portions is substantially homogenized. This facilitates the passage of bubbles, thereby reducing burnout, especially over the boiling faces where the number of bubbles is large.

Openings 92 may be replaced by (not-shown) louvers which are cut from side faces 90 of corrugated fins 82. In this case, too, the passage portions adjoined to each other through side faces 90 can communicate through the openings made by the louvers. As a result, bubbles rising in one passage portion can advance into other passage portions through the louvers similar to openings 92. However, the louvers have the advantage of allowing adjacent passages to communicate while maintaining the surface area of corrugated fins 82 as unchanged. This holds true even if the louvers are formed on the side faces 90 of corrugated fins 82. As such, the radiating area is not reduced even with the presence of the louvers.

FIG. 44*a* is a sectional view along line I—I of FIG. 41 and FIG. 44*b* is a sectional view along III—III of FIG. 41 of a refrigerant tank 3 according to a nineteenth embodiment of the present invention. In this embodiment, as shown in FIGS. 44*a* and 44*b*, upper corrugated fins 76 have a larger fin pitch Pb than the fin pitch Pa of lower corrugated fins 74. As such, the opening size of each upper passage portion 72 is larger than the opening size of each lower passage portion 70. Therefore, even if the number of bubbles increases, the ratio of the number of bubbles to the average open area can be homogenized between the lower passage portions 70 and the upper passage portions 72. As a result, upper passage portions 72 can be filled more stabally with refrigerant, thereby reducing burnout in upper portions of the boiling faces.

Figure 45:
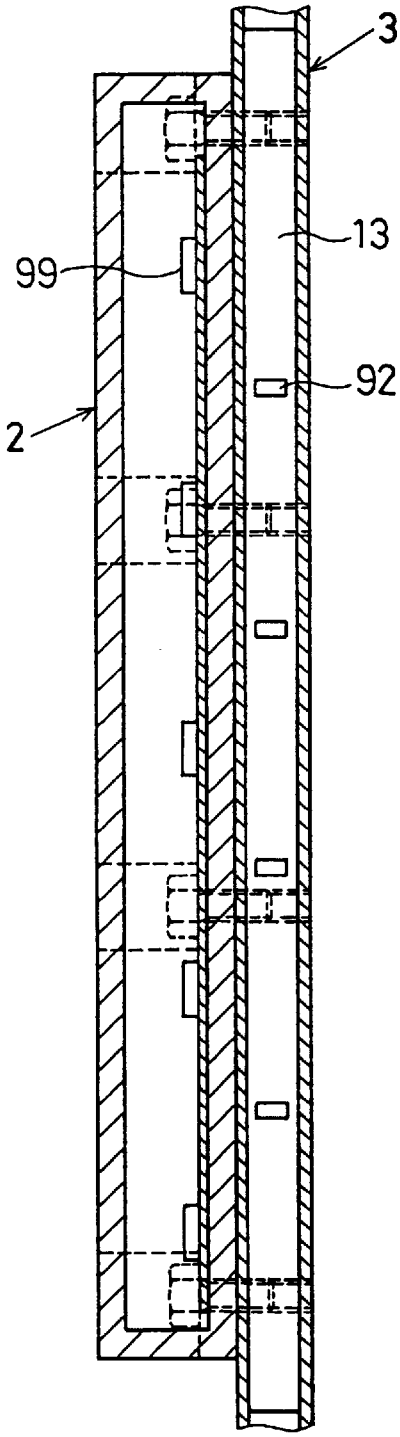
FIG. 45 is a side cross-sectional view of a refrigerant tank with a heating body attached thereon for a boiling and cooling device according to the present invention.
Figure 46A:
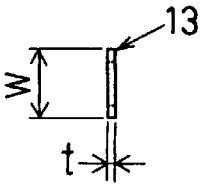
FIG. 46*a* is a front view of a rib for a boiling and cooling device according to the present invention.
Figure 46B:
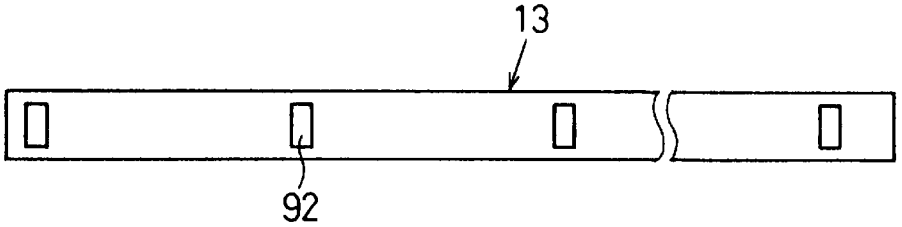
FIG. 46*b* is a side view of a rib for a boiling and cooling device according to the present invention.

FIG. 45 shows a vertical sectional view of refrigerant tank 3 for a twentieth embodiment of the present invention. In this embodiment, a plurality of ribs 13 are used to increase the boiling area. As shown in FIG. 46, ribs 13 have a constant thickness t and width w. The ribs 13 are formed as slender plate-shapes. Each rib 13 has a plurality of rectangular holes 92, which penetrate the plate shape in a thickness direction.

As shown in FIG. 47, a depression portion 94 is provided in the refrigerant tank 3 for supporting the rib 13 to both inner walls in refrigerant chamber 8. The depression portion 94 is vertically extended along the refrigerant tank 8 and is formed in a groove-shape.

Figure 47A:
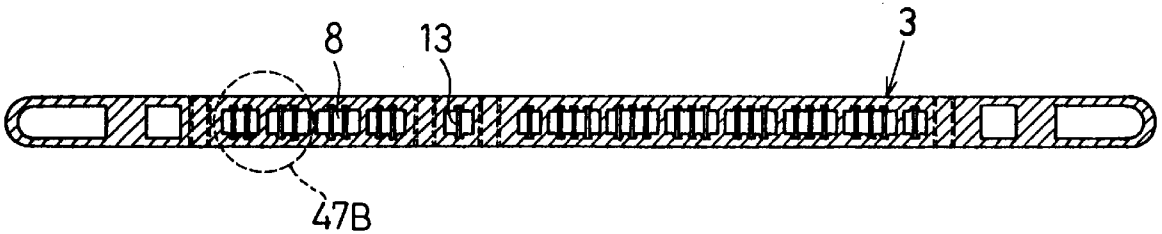
FIG. 47*a* is a front cross-sectional view along lines VIII—VIII of a refrigerant tank of FIG. 48 for a heating cooling device according to the present invention.
Figure 47B:
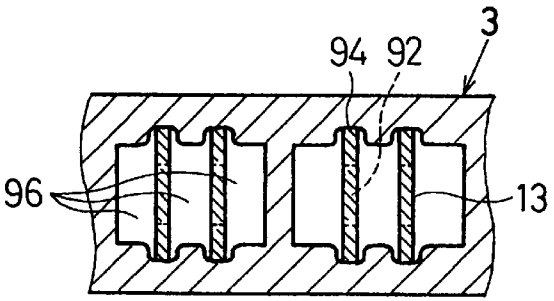
FIG. 47*b* is a partial magnified cross-sectional view of a refrigerant tank of FIG. 47*a* for a heating cooling device according to the present invention.
Figure 48:
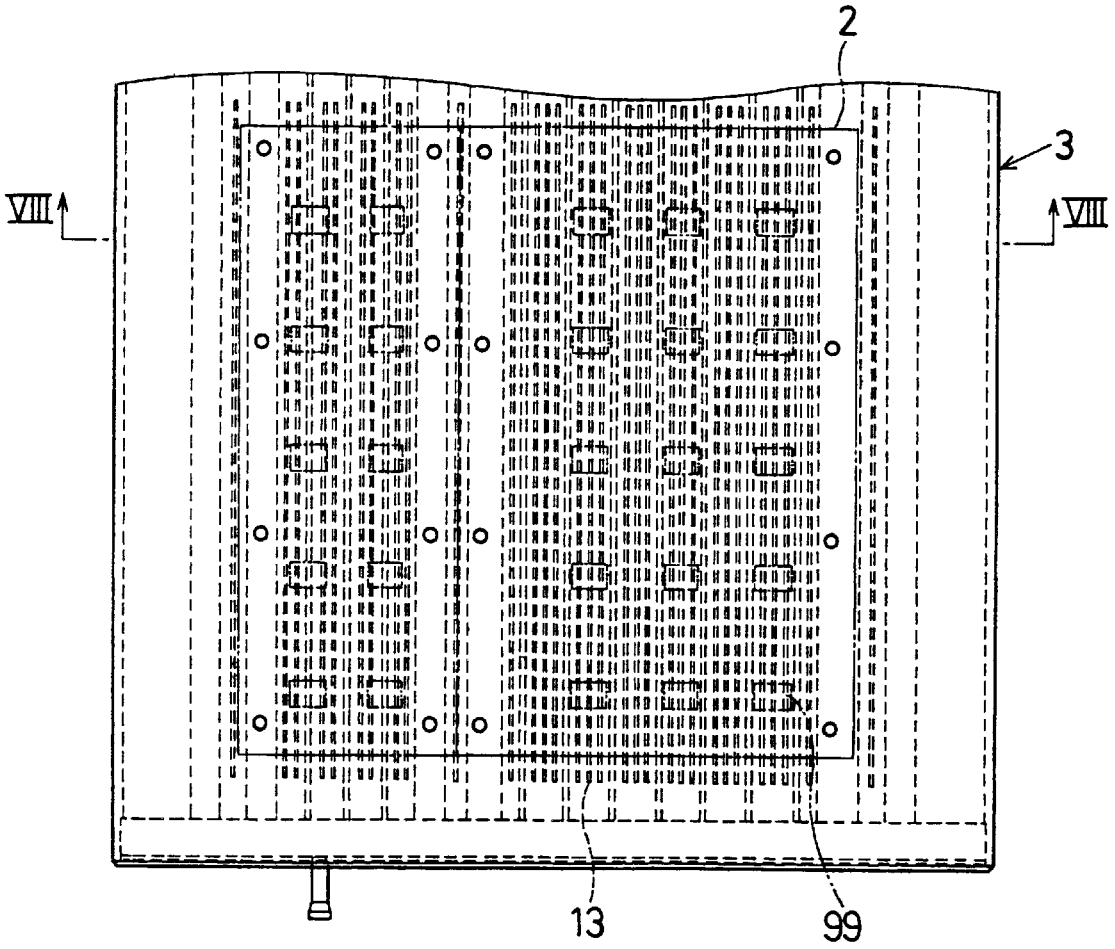
FIG. 48 is a top plan view of a refrigerant tank for a boiling and cooling device according to the present invention.

FIG. 47*a* shows a sectional view taken along line VIII—VIII of the refrigerant tank in FIG. 48. FIG. 47*b* is an enlarged view of FIG. 47*a*. As shown in FIG. 47, the rib 13 is assembled by both end portions being inserted, in the width direction, into depression portion 94. This divides the refrigerant chamber 8 into a plurality of passage portions 96. It should be understood that each passage portion, divided by rib 96, communicates with each other via through hole 92 provided in the rib 13.

In operation, bubbles rising in a passage portion 96 can enter other passage portions via through hole 92 in rib 13. In this way, the amount of bubbles in each passage portion is substantially homogenized. As such, there is no deviation of bubbles on the boiling surface, .and:it prevents abrupt temperature rising (burn-out) on the boiling surface.

As shown in FIG. 48, the heating body 2 has a plurality of heating portions 99, such as computer chips. As such, the areas beneath heating portions 99 have the highest temperature. Therefore, as shown in FIG. 45, rib 13 is preferably positioned such that heating portions 99 are vertically deviated from through hole 92 of the rib 13. Since heating portions 99 have the highest temperature, positioning through hole 92 beneath heating portion 99 can result in less efficient cooling.

While the above-described embodiments refer to examples of usage of the present invention, it is understood that the present invention may be applied to other usage, modifications and variations of the same, and is not limited to the disclosure provided herein.

What is claimed is:

1. A boiling and cooling apparatus comprising:

a refrigerant tank for maintaining a liquid refrigerant for boiling when it receives heat from a heating body;

a radiator which receives refrigerant vapor boiled in said refrigerant tank, said radiator cooling refrigerant vapor to form said liquid refrigerant by exchanging heat with an external fluid;

wherein said radiator includes a first passage for receiving said refrigerant vapor and a second passage for returning condensed liquid to aid refrigerant tank, said radiator having an upper space which provides communication between said first passage and said second passage, whereby said refrigerant vapor is guided to flow preferentially into said first passage, wherein said refrigerant tank is positioned substantially horizontal with respect to said radiator, wherein an upper end opening of said refrigerant tank is positioned under an opening of said first passage; and a refrigerant flow control plate interposed below an upper end opening of said refrigerant tank, said refrigerant vapor flowing from said upper opening of said refrigerant tank, said refrigerant vapor flowing from said upper opening of said refrigerant tank to said radiator, said control plate guiding said refrigerant vapor to flow from said upper end opening of said refrigerant tank into said first passage and substantially preventing said refrigerant vapor from flowing into said second passage;

wherein said control plate has a first plate end attached to said refrigerant tank and second plate end suspended below said first passage of said radiator.

2. A boiling and cooling apparatus as claimed in claim 1, wherein said first end is disposed below said second passage of said radiator.

3. A boiling and cooling apparatus comprising:

a refrigerant tank for maintaining a liquid refrigerant for boiling when it receives heat from a heating body;

a radiator which receives refrigerant vapor boiled in said refrigerant tank, said radiator cooling refrigerant vapor to form said liquid refrigerant by exchanging heat with an external fluid;

wherein said radiator includes a first passage for receiving said refrigerant vapor and a second passage for returning condensed liquid to said refrigerant tank, said radiator having an upper space which provides communication between said first passage and said second passage, whereby said refrigerant vapor it guided to flow preferentially into said first passage; and a refrigerant flow control plate interposed below an upper end opening of said refrigerant tank, said refrigerant vapor flowing from said upper opening of said refrigerant tank to said radiator, said control plate guiding said refrigerant vapor to flow from said upper end opening of said refrigerant tank into said first passage and substantially preventing said refrigerant vapor from flowing into said second passage, wherein said control plate has a first plate end attached to said refrigerant tank and a second plate end suspended below said first passage of said radiator.

4. A boiling and cooling apparatus comprising:

a refrigerant tank having a first surface, said refrigerant tank having refrigerant chambers therein to reserve a liquid refrigerant, said refrigerant tank having a heating body mounted on said first surface; and a radiator which receives refrigerant vapor boiled in said refrigerant tank, said radiator cooling refrigerant vapor to form said liquid refrigerant by exchanging beat with an external fluid;

wherein said refrigerant tank and refrigerant chambers are formed as an extrusion molding, said refrigerant chambers including a plurality of plate members arranged in said refrigerant chambers which are in contact with at least a first inner wall of said refrigerant tank, said first inner wall having a higher temperature rise than an opposing second inner wall of said refrigerant tank; and wherein said plate members are made of a metal having excellent heat conduction and having a plurality of notches opened in one-end face, said end face in contact with said first inner wall, wherein said plate members are made of a cladding material having a soldering material on at least its one face.

5. A boiling and cooling apparatus comprising:

a refrigerant tank having a first surface, said refrigerant tank having refrigerant chambers therein to reserve a liquid refrigerant, said refrigerant tank having a heating body mounted on said first surface; and a radiator which receives refrigerant vapor boiled in said refrigerant tank, said radiator cooling refrigerant vapor to form said liquid refrigerant by exchanging heat with an external fluid;

wherein said refrigerant tank and refrigerant chambers are formed as an extrusion molding, said refrigerant chambers including a plurality of plate members arranged in said refrigerant chambers which are in contact with at least a first inner wall of said refrigerant tank, said first inner wall having a higher temperature rise than an opposing second inner wall of said refrigerant tank; and wherein said plate members are made of a metal having excellent heat conduction and having a plurality of notches opened in one-end face, said end face in contact with said first inner wall, wherein said extrusion molding includes inner grooves in said first inner wall, said one end-face of said plate members is inserted into a respective groove to position said plate members.

6. A boiling and cooling apparatus comprising:

a refrigerant tank having a first surface, said refrigerant tank having refrigerant chambers therein to reserve a liquid refrigerant, said refrigerant tank having a heating body mounted on said first surface; and a radiator which receives refrigerant vapor boiled in said refrigerant tank, said radiator cooling refrigerant vapor to form said liquid refrigerant by exchanging heat with an external fluid;

wherein said refrigerant tank and refrigerant chambers are formed as an extrusion molding, said refrigerant chambers including a plurality of plate members arranged in said refrigerant tank, said first inner wall having a higher temperature rise than an opposing second inner wall of said refrigerant tank; and wherein said plate members are made of a metal having excellent heat conduction and having a plurality of notches opened in one-end face, said end face in contact with said first inner wall, and wherein said first inner wall is said inner wall of said first surface.

7. A boiling and cooling apparatus as claimed in claim 6, wherein said plate members define a flow passage on a plate member side opposite said notch side of plate member.

8. A boiling and cooling apparatus comprising:

a refrigerant tank having a refrigerant chamber therein to reserve a liquid refrigerant; and a radiator which receives refrigerant vapor boiled in said refrigerant tank, said radiator cooling refrigerant vapor to form said liquid refrigerant by exchanging heat with an external fluid;

wherein said refrigerant tank having a heat transfer face for transferring heat from a heating body to a liquid refrigerant, said refrigerant tank having a heat transfer face positioned opposite a second wall, said heat transfer face having a plurality of ribs disposed thereon, wherein said ribs are provided with a plurality of recesses which increase a boiling area of said heat transfer face and are set to a minimum opening width of between one and three times a Laplace's length.

9. A boiling and cooling apparatus as claimed in claim 8, wherein said recesses have a depth of two to eight times of said Laplace's length.

10. A boiling and cooling apparatus as in claim 8, wherein said refrigerant chamber and ribs are formed from an extrusion molding, wherein said ribs are formed along said heat transfer face, said heat transfer face having a higher temperature than said opposing wall.

11. A boiling and cooling apparatus as set forth in claim 8, wherein said recesses are opened in a slit shape in plate members.

12. A boiling and cooling apparatus as set forth in claim 11, wherein said boiling face is provided with grooves, wherein side portions of said plate members are inserted into said grooves to position said plate members in said refrigerant tank.

13. A boiling and cooling apparatus as set forth in claim 11, wherein said plate members are made of a cladding material having a soldering material on at least one face.

14. A boiling and cooling apparatus comprising:

a refrigerant tank for maintaining a liquid refrigerant for boiling when it receives heat from a heating body;

a radiator which receives refrigerant vapor boiled in said refrigerant tank, said radiator cooling refrigerant vapor to form said liquid refrigerant by exchanging heat with an external fluid; and wherein said radiator includes a first passage for receiving said refrigerant vapor and a second passage for returning condensed liquid refrigerant to said refrigerant tank, said radiator having an upper space which provides communication between said first passage and said second passage, whereby said refrigerant vapor is guided to flow preferentially into said first passage, wherein said refrigerant tank is positioned substantially horizontal with respect to said radiator, an upper opening of said refrigerant tank is positioned under an opening of said first passage and said refrigerant vapor in said first passage and said liquid refrigerant in said second passage flow in a direction that crosses said refrigerant tank.

15. A boiling and cooling apparatus as claimed in claim 14, further comprising a refrigerant flow control plate interposed below an upper end opening of said refrigerant tank, said refrigerant vapor flowing from said upper opening of said refrigerant tank to said radiator, said control plate guiding said refrigerant vapor to flow from said upper end opening of said refrigerant tank into said first passage and substantially preventing said refrigerant vapor from flowing into said second passage.

16. A boiling and cooling apparatus as in claim 15, wherein said upper end opening is proximate a first one of said first passage and said second passage.

17. A boiling and cooling apparatus as in claim 14, wherein an upper end opening of said refrigerant tank is positioned substantially perpendicular to an opening in said radiator.

18. A boiling and cooling apparatus as in claim 14, wherein said radiator includes:

a plurality of tubes, each of said plurality juxtaposed to at least another of said plurality through radiation fins; and a condensation area increasing member for increasing a condensation area in said tubes, said condensation area inserted into each of said tubes, said condensation area defining an inside of said tubes into a plurality of passages, said condensation area defining said first passage and said second passage.

19. A boiling and cooling apparatus as in claim 18, wherein said condensation area increasing member includes corrugated inner fins.

20. A boiling and cooling apparatus as set forth in claim 19, wherein:

said condensation area increasing member defines said second passage with a smaller pitch than said first passage.

21. A boiling and cooling apparatus as set forth in claim 18, wherein said first passage is formed at a central area of said plurality of tubes, wherein said second passage is formed on opposite sides of said first passage.

22. A boiling and cooling apparatus according to claim 18, wherein said first passage and said second passage are positioned in a predetermined cooling wind direction, wherein said first passage is disposed downstream of said second passage with respect to said cooling wind direction.

23. A boiling and cooling apparatus as in claim 14, wherein said radiator includes a lower tank disposed below said plurality of tubes for providing fluid communication among said plurality of tubes, wherein said refrigerant tank includes a refrigerant chamber having a refrigerant boiling region in communication with a recirculation passage, said recirculation passage for recirculating, the liquid coolant into said refrigerant chamber, said refrigerant chamber and said recirculation passage having upper end openings, said upper end openings being positioned in said lower tank, said upper end openings of said recirculation passage being positioned at a lower level than that of said refrigerant chamber.

24. A boiling and cooling apparatus as in claim 15, wherein said radiator space includes a plurality of tubes disposed in parallel and said control plate is positioned below said tubes in a vicinity of said refrigerant tank on which the heating body is mounted.

25. A boiling and cooling apparatus as in claim 24, wherein said heating body is disposed substantially at a center of said refrigerant tank and said control plate is disposed substantially below said center tubes of said radiation space.

26. A boiling and cooling apparatus as in claim 15, wherein said first plate end and said second plate end of said control plate is substantially parallel to said refrigerant tank.

27. A boiling and cooling apparatus as set forth in claim 14, wherein the first passage and the second passage extend vertically.

* * * * *